US009388973B1

(12) United States Patent
Olsson et al.

(10) Patent No.: US 9,388,973 B1
(45) Date of Patent: Jul. 12, 2016

(54) SUBMERSIBLE LIGHTS WITH PRESSURE COMPENSATION

(71) Applicants: Mark S. Olsson, La Jolla, CA (US); Kevin R. Hardy, San Diego, CA (US); John R. Sanderson, Poway, CA (US); Brian P. Lakin, San Diego, CA (US); Ray Merewether, La Jolla, CA (US); Jon E. Simmons, Poway, CA (US); Kenneth A. Steeves, San Diego, CA (US)

(72) Inventors: Mark S. Olsson, La Jolla, CA (US); Kevin R. Hardy, San Diego, CA (US); John R. Sanderson, Poway, CA (US); Brian P. Lakin, San Diego, CA (US); Ray Merewether, La Jolla, CA (US); Jon E. Simmons, Poway, CA (US); Kenneth A. Steeves, San Diego, CA (US)

(73) Assignee: DEEPSEA POWER & LIGHT, INC., San Diego, CA (US)

( * ) Notice: Subject to any disclaimer, the term of this patent is extended or adjusted under 35 U.S.C. 154(b) by 0 days.

(21) Appl. No.: 14/154,137

(22) Filed: Jan. 13, 2014

Related U.S. Application Data

(63) Continuation of application No. 13/252,182, filed on Oct. 3, 2011, now Pat. No. 8,632,230, which is a continuation of application No. 12/185,007, filed on Aug. 1, 2008, now Pat. No. 8,033,677.

(51) Int. Cl.

| | |
|---|---|
| ***F21V 31/00*** | (2006.01) |
| ***B63G 8/00*** | (2006.01) |
| ***F21V 31/04*** | (2006.01) |
| ***B63B 45/04*** | (2006.01) |

(52) U.S. Cl.
CPC ..... *F21V 31/04* (2013.01); *B63B 45/04* (2013.01); *B63B 2702/00* (2013.01)

(58) Field of Classification Search
CPC .. F21W 2131/401; F21V 31/00; B63B 45/04; B63B 45/02; B63B 2702/00; B63B 2201/08; B63G 8/001
USPC ..... 362/101
See application file for complete search history.

(56) References Cited

U.S. PATENT DOCUMENTS

| | | | | |
|---|---|---|---|---|
| 4,344,118 | A | 8/1982 | Rundquist | |
| 4,683,523 | A | 7/1987 | Olsson | |
| 4,996,635 | A | 2/1991 | Olsson | |
| 6,471,366 | B1 | 10/2002 | Hughson | |
| 6,619,818 | B2 | 9/2003 | Grove | |
| 7,722,216 | B2 * | 5/2010 | Amor et al. | 362/249.01 |
| 7,866,850 | B2 | 1/2011 | Alexander | |

(Continued)

OTHER PUBLICATIONS

Hardy, Kevin R, et al, "High Brightness Light Emitting Diodes for Ocean Applications," OCEAN, Oct. 3, 2007, USA.

(Continued)

*Primary Examiner* — Peggy Neils
(74) *Attorney, Agent, or Firm* — Steven C. Tietsworth, Esq.

(57) ABSTRACT

A deep submersible light may include a body defining a hollow interior and a solid state light source such as a plurality of high brightness LEDs mounted in the interior of the body. A transparent window may be mounted over the LEDs. The space between the transparent window and the LEDs may be filled with an optically transparent fluid, gel, or grease, which allows light to pass through and ambient water pressure to pass in, thus pressure compensating the LEDs by allowing them to see ambient water pressure. The transparent window may be mounted in the body for reciprocation in both a forward direction and a rearward direction to accommodate volumetric changes in the compensating fluid, gel, or grease caused by changes in temperature and water pressure as the manned or remotely piloted submarine travels from the sea surface to deep ocean depths.

13 Claims, 33 Drawing Sheets

(56) References Cited

U.S. PATENT DOCUMENTS

| | | | | |
|---|---|---|---|---|
| 7,888,883 | B2 | 2/2011 | Crawford | |
| 7,922,359 | B2 | 4/2011 | Chiang | |
| 2010/0002435 | A1* | 1/2010 | Rash | 362/235 |
| 2012/0262771 | A1 | 10/2012 | Olsson | |

OTHER PUBLICATIONS

Olsson, Mark S. et al, "Underwater Applications of High-Power Ligh-Emitting Diodes," SEA Technology, Aug. 20, 2007, pp. 31-34, vol. 48, No. 8, USA.

* cited by examiner

Parallel Rays

Spread Rays

Spread Rays

Even Flood

SUBMERSIBLE LIGHTS WITH PRESSURE COMPENSATION

CROSS-REFERENCE TO RELATED APPLICATIONS

This application is a continuation of and claims priority to co-pending U.S. Utility patent application Ser. No. 13/252,182, entitled DEEP SUBMERSIBLE LIGHT WITH PRESSURE COMPENSATION, filed Oct. 3, 2011, which is a continuation of and claims priority to U.S. Utility patent application Ser. No. 12/185,007, entitled DEEP SUBMERSIBLE LIGHT WITH PRESSURE COMPENSATION, filed Aug. 1, 2008, now U.S. Pat. No. 8,033,677. This application claims priority to each of these applications, and the content of each of these applications is hereby incorporated by reference herein in its entirety for all purposes.

FIELD

This disclosure relates generally to underwater lighting devices. More particularly, but not exclusively, the invention relates to lights with pressure compensation for use at depths that are subjected to very high ambient water pressure.

BACKGROUND

Prior art underwater lighting fixtures have used gas discharge or incandescent filaments housed in thin glass envelopes as the light source. These glass envelopes collapse at depths as shallow as 100 feet, and cannot operate in contact with any liquids. To go any deeper, these glass envelopes must be protected from direct ocean pressure to prevent them from imploding. Typical designs use a glass dome or flat window, with a metal or heavy plastic housing. A pressure proof underwater electrical bulkhead connector brings electrical power across the interface.

FIG. 1 illustrates a Multi SeaLite® light fixture 102 commercially available from DeepSea Power & Light of San Diego, Calif., assignee of the instant application. The light fixture 102 utilizes a halogen gas-filled glass envelope lamp that must be protected from direct exposure to high ocean pressure. More particularly, referring to FIG. 2, a halogen lamp 204 is included in the light fixture 102. The halogen lamp 204 includes a thin inert gas-filled glass envelope that is only designed to survive atmospheric pressure differences found in typical applications from sea level to mountain tops. In order to survive at great ocean depths, e.g. 3,000 meters or more, the light fixture 102 includes a pressure protected housing that includes a glass hemisphere 202, metal back shell 206, cowl 212, and bulkhead connector 210. An internal reflector 214 redirects lights from the halogen lamp 204 forward through the glass hemisphere 202. A mount 208 permits the light assembly to attach to a manned or remotely piloted submarine. See U.S. Pat. Nos. 4,683,523 and 4,996,635, both of Mark S. Olsson et al., for further details regarding the construction of light fixture 102.

High brightness light emitting diodes (LEDs) have begun to be used in terrestrial markets as a reliable, efficient solid state light source capable of narrow or wide chromatic bandwidth. FIG. 3A illustrates an individual Cree XRE high brightness LED 302. It comprises light-emitting die 306 (FIG. 3B) illustrated centrally situated above a ceramic base 312, encapsulated with silicone gel 310, contained by a metallic ring 308, that supports a transparent dome-shaped lens element 304. Electrical contacts 314 and 320 are placed on top of the ceramic base 312, and a duplicate pair 316 and 322 are placed on the underside. A thermal-transfer pad 318 is also located in the center of the underside of the ceramic base to aid in drawing heat away from the die 306.

It would be desirable to provide a deep submersible light that takes advantage of the new high brightness LEDs that have become commercially available. LEDs in such a light can accommodate very high ambient water pressures directly, but due to the electrical nature of the LEDs requires that they be isolated from seawater, which is electrically conductive.

Accordingly, there is a need in the art to address the above deficiencies as well as other problems in the underwater lighting field.

SUMMARY

In accordance with one aspect, a deep submersible light includes a body defining a hollow interior and a solid state light source such as a plurality of high brightness LEDs mounted in the interior of the body. A transparent window may be mounted over the LEDs. The space between the transparent window and the LEDs may be filled with an optically transparent fluid, gel, or grease, which allows light to pass through and ambient water pressure to pass in, thus pressure compensating the LEDs by allowing them to see ambient water pressure. The transparent window may be mounted in the body for reciprocation in both a forward direction and a rearward direction to accommodate volumetric changes in the compensating fluid, gel, or grease caused by changes in temperature and water pressure as the manned or remotely piloted submarine travels from the sea surface to deep ocean depths.

Various additional aspects, details, and functions are further described below in conjunction with the appended Drawings.

BRIEF DESCRIPTION OF THE DRAWINGS

The present disclosure may be more fully appreciated in connection with the following Detailed Description taken in conjunction with the accompanying drawings, wherein.

DETAILED DESCRIPTION OF EMBODIMENTS

The entire disclosure of co-pending U.S. patent application Ser. No. 12/036,178 filed Feb. 22, 2008 of Mark S. Olsson et al. is hereby incorporated by reference. That application is entitled "LED Illumination System and Methods of Fabrication."

Figure 3A:
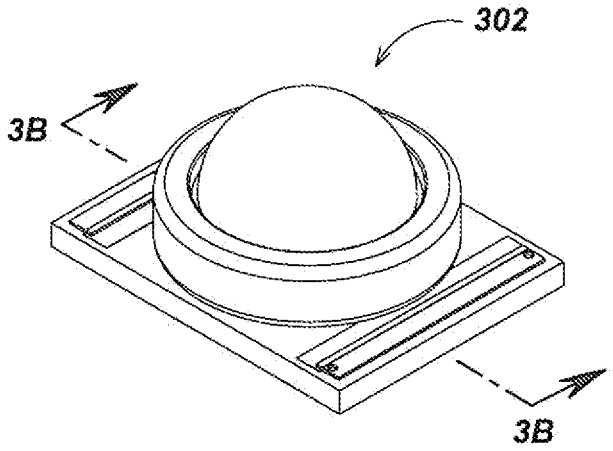
PRIOR ART FIG. 3A
FIG. 3A is an isometric view of a prior art high intensity LED.
Figure 3B:
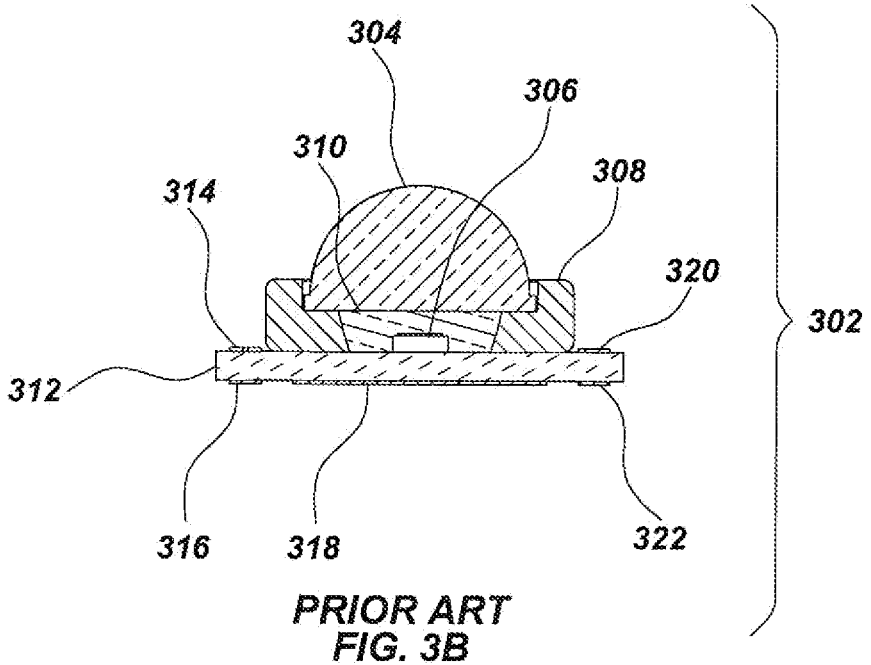
PRIOR ART FIG. 3B
FIG. 3B is a sectional view of the LED of FIG. 3A taken along line 3B-3B.
Figure 3C:
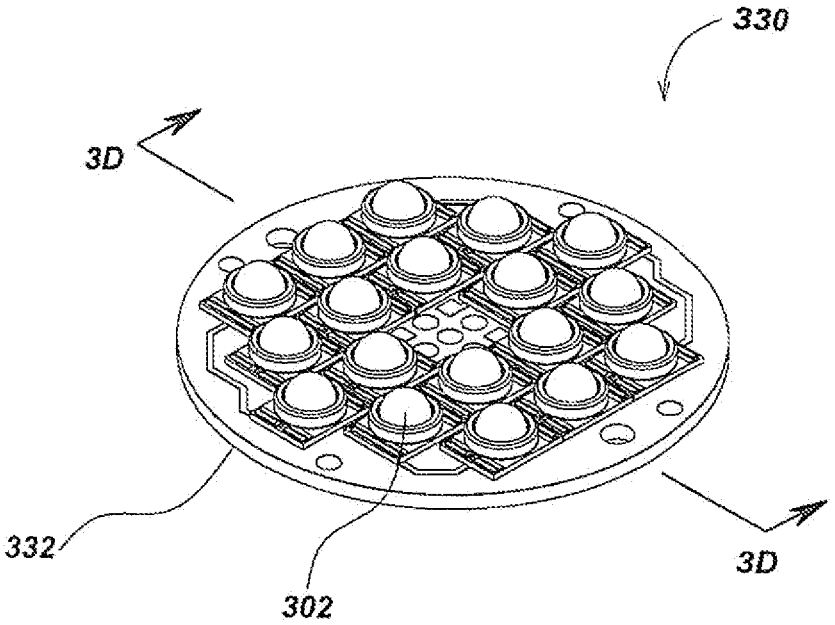
FIG. 3C is an isometric view of a metal core printed circuit board (MCPCB) assembly populated with eighteen LEDs.
Figure 3D:
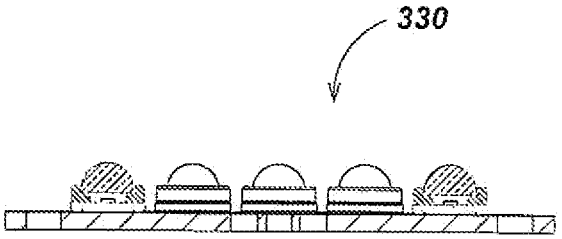
FIG. 3D is a section view of the LED assembly of FIG. 3C taken along line 3D-3D.
Figure 3E:
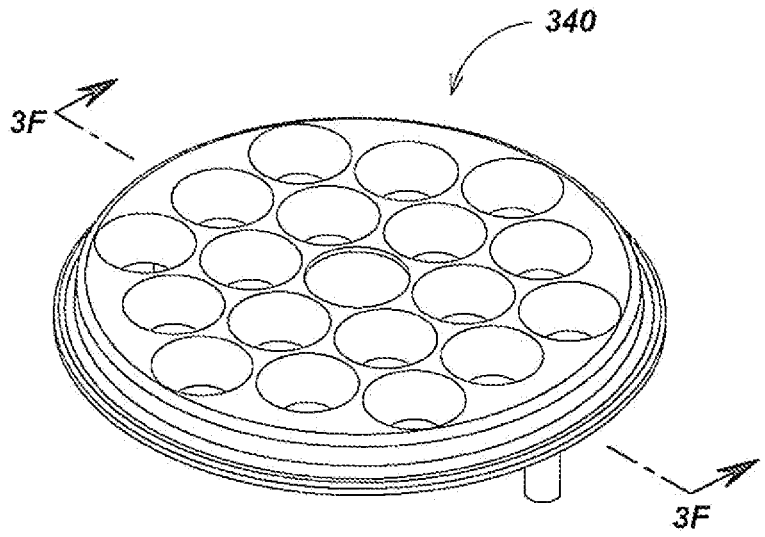
FIG. 3E is an isometric view of a molded reflector.
Figure 3F:
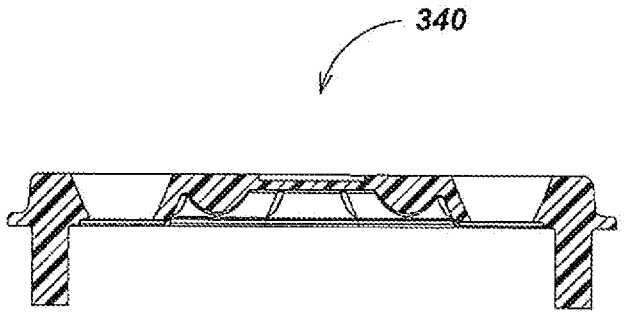
FIG. 3F is a section view of the molded reflector of FIG. 3E taken along line 3F-3F.
Figure 4:
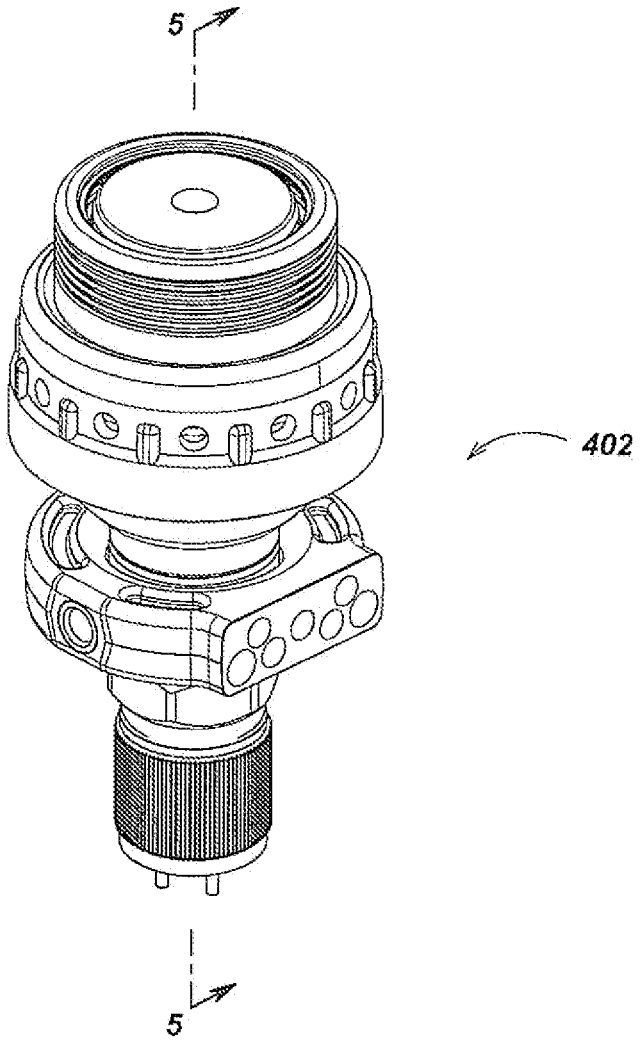
FIG. 4 is an isometric view of a deep submersible light incorporating an embodiment of the present invention.
Figure 5:
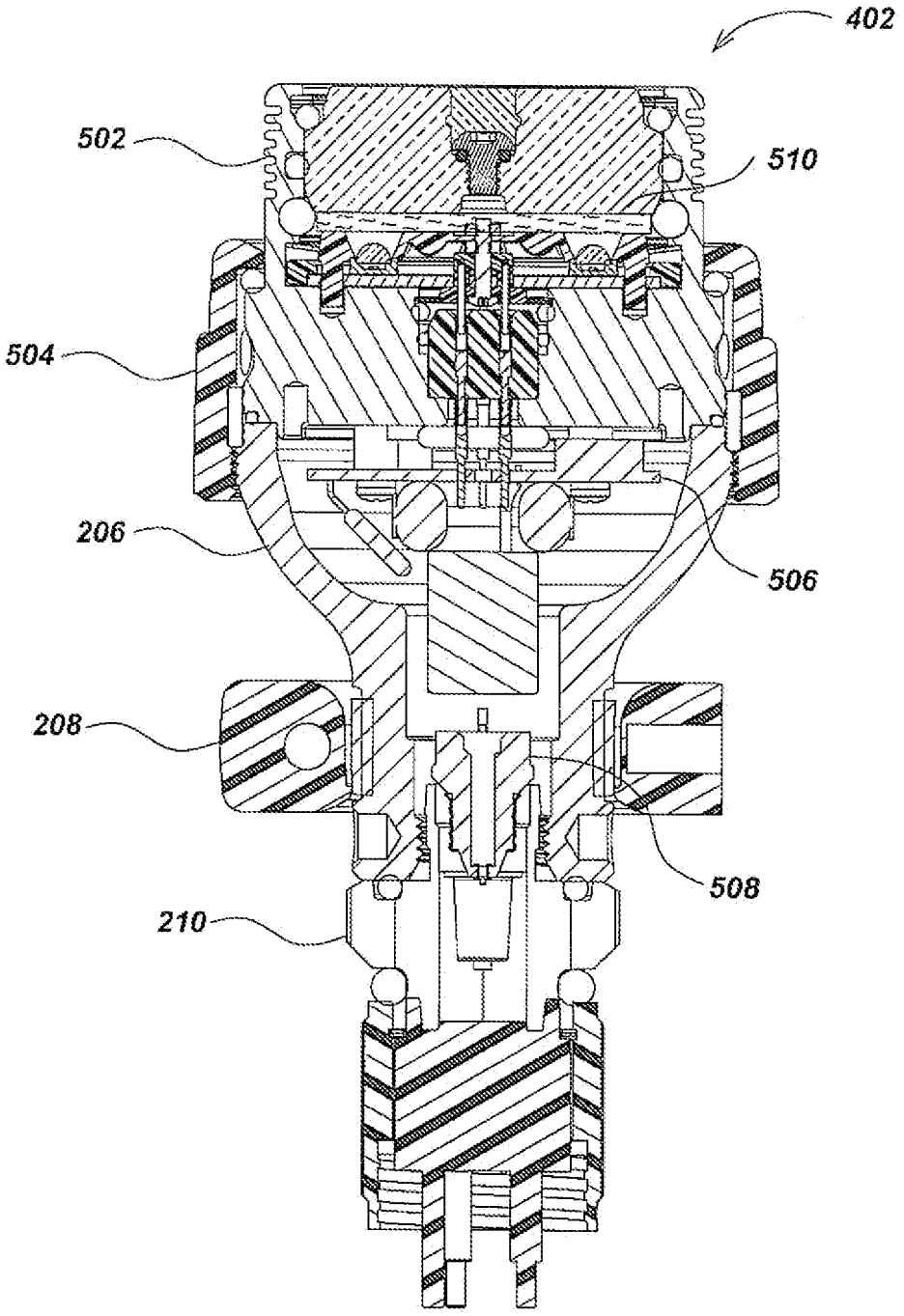
FIG. 5 is a section view of the light of FIG. 4 taken along line 5-5.

FIGS. 3C, 3D, 3E and 3F illustrate structure that is incorporated into the deep submersible light of FIGS. 4 and 5. More particularly, FIG. 3C illustrates an array of eighteen Cree XRE high brightness LEDs 302 combined with a metal core printed circuit board (MCPCB) 332 in an assembly 330, which may referred to as a light engine. FIG. 3D illustrates a section view of the assembly 330. FIG. 3E illustrates a metalized molded plastic multiple-reflector plate 340, which is designed such that the light-emitting parts of the LEDs 302 (FIG. 3C) protrude through the reflector openings when aligned for placement above the LED/MCPCB assembly 330 (FIG. 3C). FIG. 3F illustrates a section view of the multiple-reflector plate 340.

Referring to FIGS. 4 and 5, in accordance with an embodiment of the present invention a deep submersible light 402 includes a cylindrical light head sub-assembly 502, a hemispherical back shell 206, a cylindrical cowl 504, a bulkhead connector 210, an electronic LED driver 506, a miniature candelabra lamp screw base 508, and a mount 208. The volume inside the back shell 206 is protected from high exterior ambient water pressure, e.g. that which would be encountered at depths of 1,400 meters and greater. At 1,400 meters, the ambient water pressure is approximately 2,000 PSI. The light head subassembly 502 functions as a pressure resistant forward bulkhead, while the bulkhead connector 210 seals the rear of the back shell 206. The screw base 508 adapts the screw socket plug of the bulkhead connector 210 to allow wires to pass to the electronic LED driver 506. The interior volume of the light head sub-assembly 502 is filled with an optically transparent dielectric fluid, grease, or gel 510 in sufficient volume to allow for volumetric change due to a combination of the cold temperature and high pressure of the deepest ocean depths. Examples of suitable fluids include Dow Corning 200, Dow 705, Dow 710, and 3M FC-70. Optical Gels include Dow Optical Coupling Gel, OE-4000. Optical Greases that are suitable include Saint-Gobain BC-630.

Figure 6A:
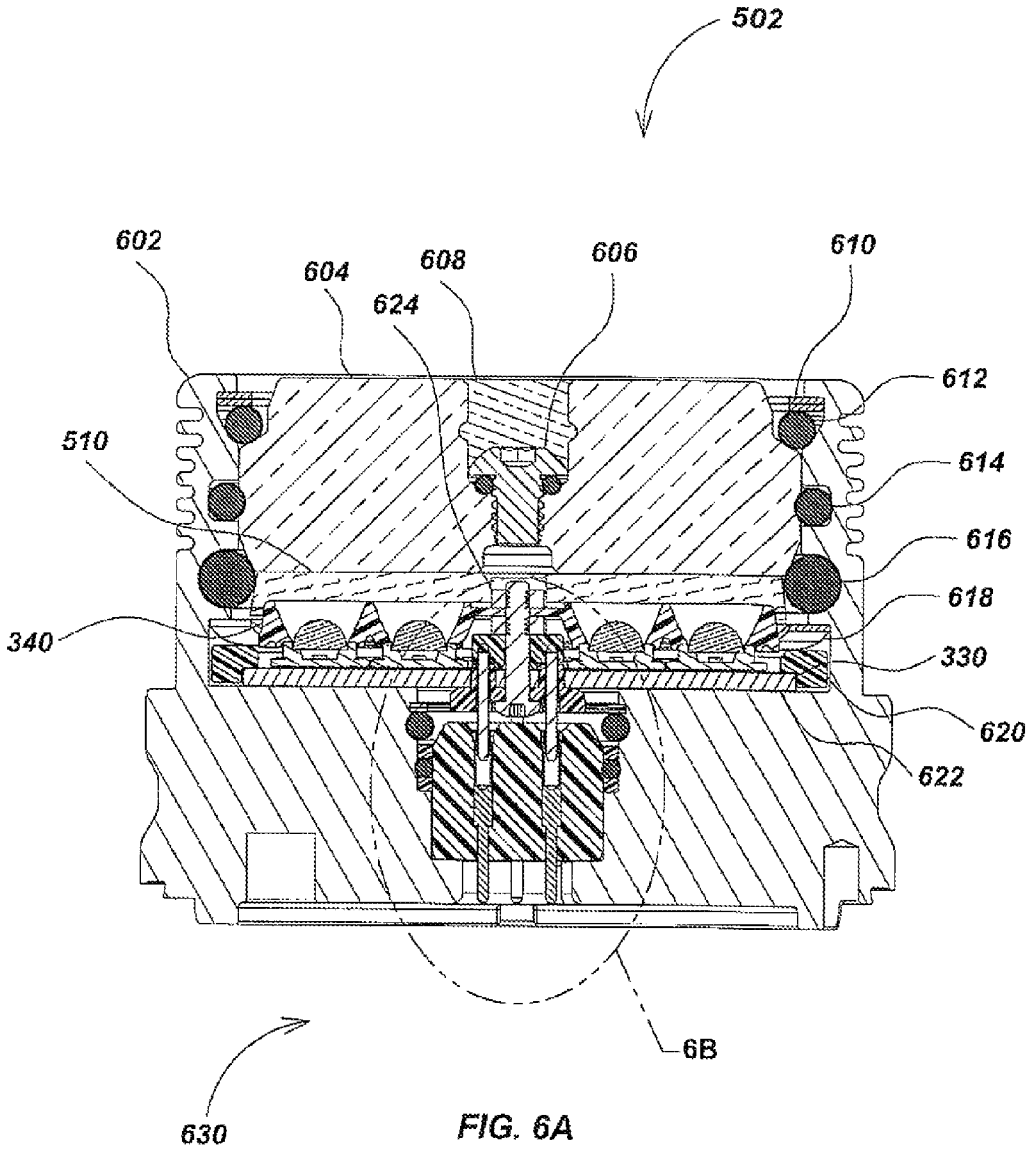
FIG. 6A is an enlarged portion of FIG. 5 illustrating details of the LED light head of the light of FIG. 4.

Referring to FIG. 6A the LED light head sub-assembly 502 includes a generally cylindrical ribbed metal body 602, a cylindrical pistoning transparent plastic window 604 extending across and sealing one end of the metal body 602, a radially sealing O-ring 614, two longitudinal centering O-rings 612 and 616, and an upper spiral retaining ring 610 to hold the window 604 in position. The metal body 602 defines a hollow interior in which the LED/MCPCB sub-assembly 330 is mounted. The plastic window 604 is substantially rigid and may be made from Acrylic, polycarbonate, Trogamid, or other materials combining suitable qualities for use at deep underwater depths. Alternatively, the window 604 could be made of various suitable non-plastic transparent materials such as glass and sapphire. The window 604 is sealed using the single radial O-ring 614 seated in a groove cut into the metal body 602. The window 604 is capable of moving axially relative to the longitudinal center line of the generally cylindrical light head sub-assembly 502 as the ambient water pressure varies during descent and ascent of a deep submersible vehicle carrying the light of FIG. 4. The forward and rearward edges of the window 604 are beveled where they engage the centering O-rings 612 and 616 to facilitate such longitudinal or reciprocal pistoning movement of the window 604. The O-ring 614 provides a water-tight seal between the window 604 and the metal body 602. This water-tight seal need not be provided by an O-ring, but could instead be provided by other means including a bellows or a flat clamp gasket.

The reciprocal transparent window 604 allows light generated by the LEDs 302 (FIG. 3C) to pass through the window outward and ambient water pressure to pass inward, thus pressure compensating the LEDs 302 (FIG. 3C). In fluid mechanics, "ambient pressure" refers to the pressure of the surrounding fluid medium, either gas or liquid, which comes into contact with an apparatus. As a submarine dives deeper into the sea, pressure increases due to the increased weight of water above it. This increase in pressure can cause materials to compress if exposed to that pressure. Systems can either be built strong enough to resist that pressure, and thus "pressure protected", or allowed to equalize to that pressure, and thus "pressure compensated." In the embodiment of this invention, the fluid, gel, or grease is the material that compresses according to pressure, and the reciprocal transparent window 604 is the mechanism that allows the volume to change as necessary. Since the fluid, gel, or grease is in direct contact with the LEDs 302 (FIG. 3C), the ambient pressure is thereby transmitted directly to the LEDs 302 (FIG. 3C).

Referring still to FIG. 6A, the LED/MCPCB sub-assembly 330, is thermally connected to a thick rear wall of the generally cylindrical metal body 602 using a Phase Change Material (PCM) 622, such as Laird Technologies T-pcm 583, and restrained and clamped by a centering collar 620 and a wave spring 618. By way of example, the metal body 602 may be made of 6061-T6 aluminum, with a Type III hard anodize conversion coating on its interior surface that provides an additional electrical isolation layer between the metal core board and the aluminum housing. The multiple-reflector plate 340 is held in position by a hex nut 624. The construction of the high pressure puck sub-assembly 630 is described below in conjunction with FIG. 6B. The interior open volume surrounding the LED/MCPCB sub-assembly 330 is filled with an optically clear, dielectric fluid, gel, or grease 510. The two longitudinal centering O-rings 612 and 616 are useful in keeping the pistoning clear plastic window 604 axially aligned down the center of the cylindrical interior of the metal body 602, eliminating the danger of tipping and wedging. A large thickness-to-bore diameter ratio would otherwise be needed.

Referring still to FIG. 6A, a seal screw 606 extends through a bore in the center of the window 604 and allows for installation of the window 604 and subsequent fluid filling during final assembly. The screw 606 is screwed into a threaded segment of a throughbore formed in the center of the window 604. An unthreaded outer extension of the throughbore in the window 604 is sealed beneath a cast-in-place, or injection molded and pressed in place, clear elastomeric plug 608. Alternatively, a pair of seal screws (not illustrated) may be inserted through bores in opposite sides of the metal body 602, to permit fluid insertion and air extraction.

Figure 6B:
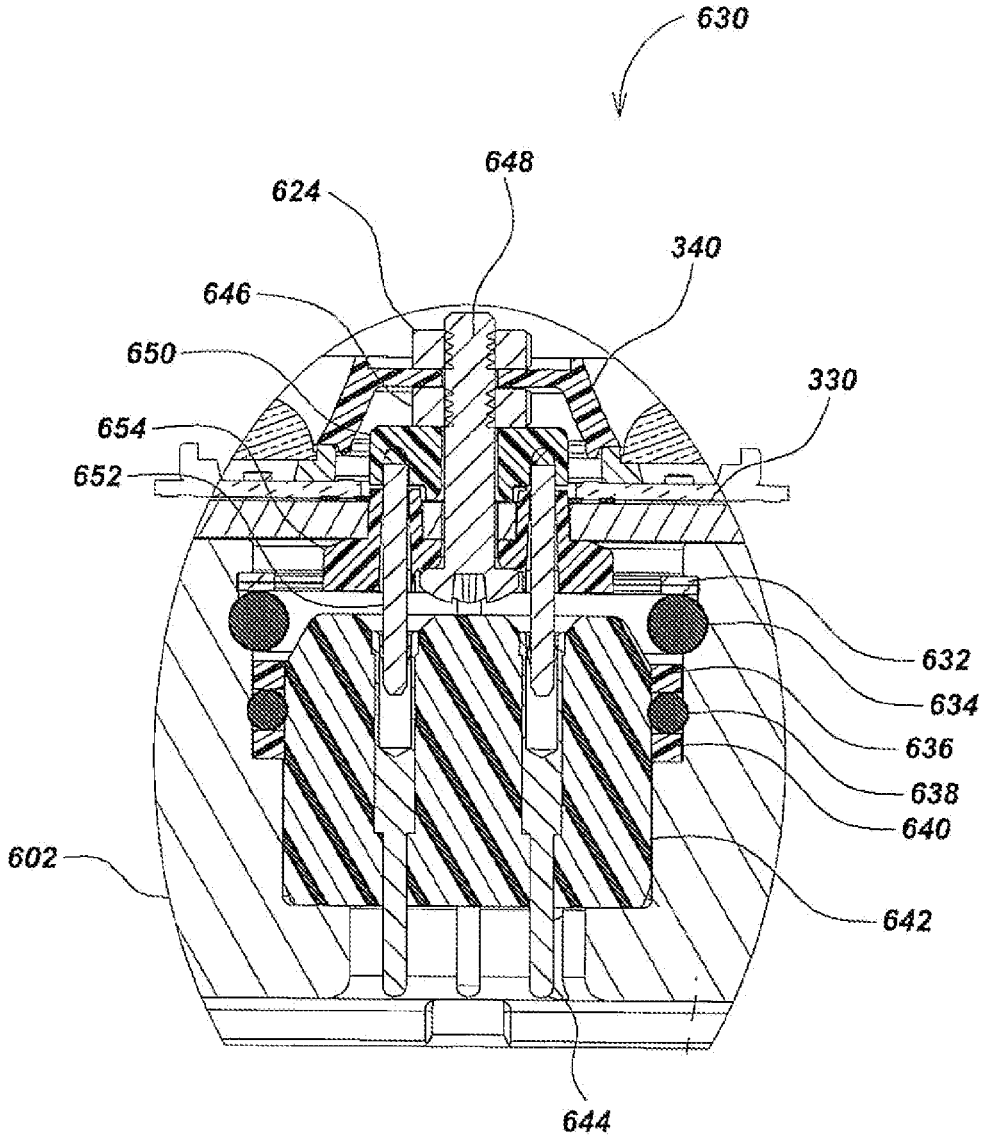
FIG. 6B is an enlargement of the portion of FIG. 6A circled in phantom lines illustrating details of the high pressure puck sub-assembly of the light of FIG. 4.

Referring to FIG. 6B, the high pressure puck sub-assembly 630 includes a high pressure puck 642 made of high strength thermosetting epoxy with molded insert electrical contacts 644, installed in a matching bore machined or otherwise formed in the metal body 602. The electrical contacts 644 are made with pins on one end and sockets on the other. The sockets are positioned to face the LED/MCPCB sub-assembly 330. The puck 642 is sealed by use of a radial O-ring 638, centered between two Teflon™ back-up rings 636 and 640. The rings 636 and 640 are squeezed into position by an upper O-ring 634, which itself is held in position by a spiral retaining ring 632. Electrical pins 652 pass from the LED/MCPCB sub-assembly 330, through an insulating centering plate 654, and into the electrical sockets in the puck 642. The electrical pins 652 are held against the LED/MCPCB sub-assembly 330 and prevented from rotating by an insulating top cap 650. This stack-up is sandwiched together by use of a through-bolt 648, and a hex nut 646. The multiple-reflector plate 340 is then added to this stack-up and held by a hex nut 624.

Figure 7A:
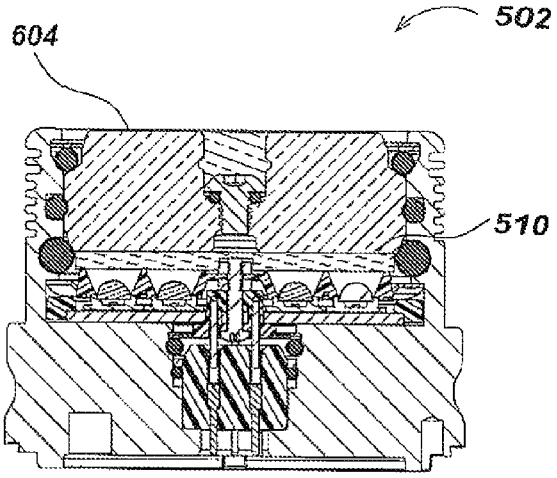
FIGS. 7A, 7B, and 7C are similar sectional views illustrating the range of motion of the pistoning front window of the light of FIG. 4.
Figure 7B:
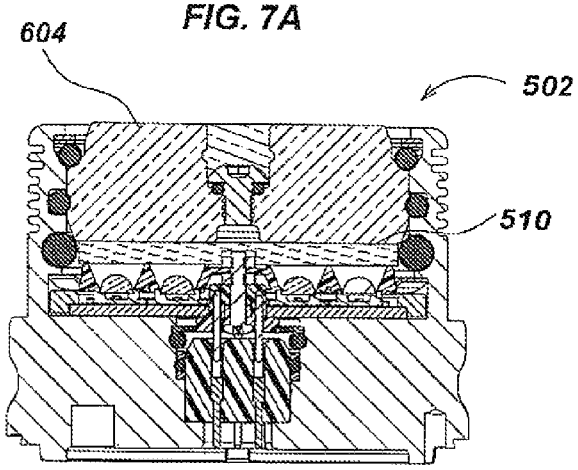
Figure 7C:
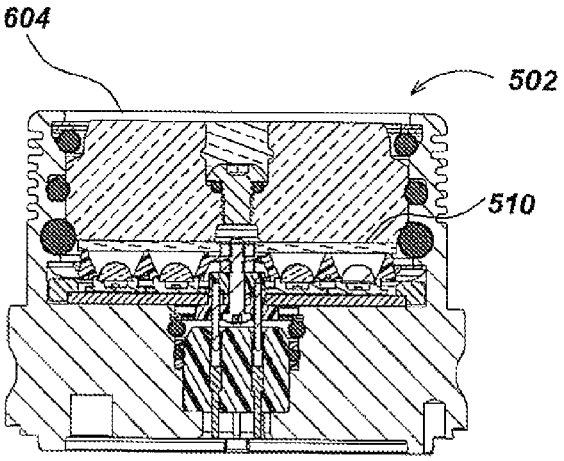

FIGS. 7A, 7B and 7C illustrates the range of motion of the pistoning transparent plastic window 604. FIG. 7A illustrates the position of the window 604 at average sea level conditions (72 degrees F. at 14.70 psi.), centered in the bore or hollow interior of the light head sub-assembly 502 with a starting volume of dielectric fluid, grease, or gel 510. FIG. 7B. illustrates the position of the window 604 centered in the bore of the light head sub-assembly 502 after it has moved axially forward as heat generated by the illumination of the LEDs causes the dielectric fluid, grease, or gel 510 inside the light to expand. FIG. 7C illustrates the position of the window 604 centered in the bore of the light head sub-assembly 502 after it has moved axially rearward due to the influence of deep ocean ambient high water pressure and cold temperatures (40 degrees F. at 10,000 psi) on the dielectric fluid, grease, or gel 510.

Figure 8:
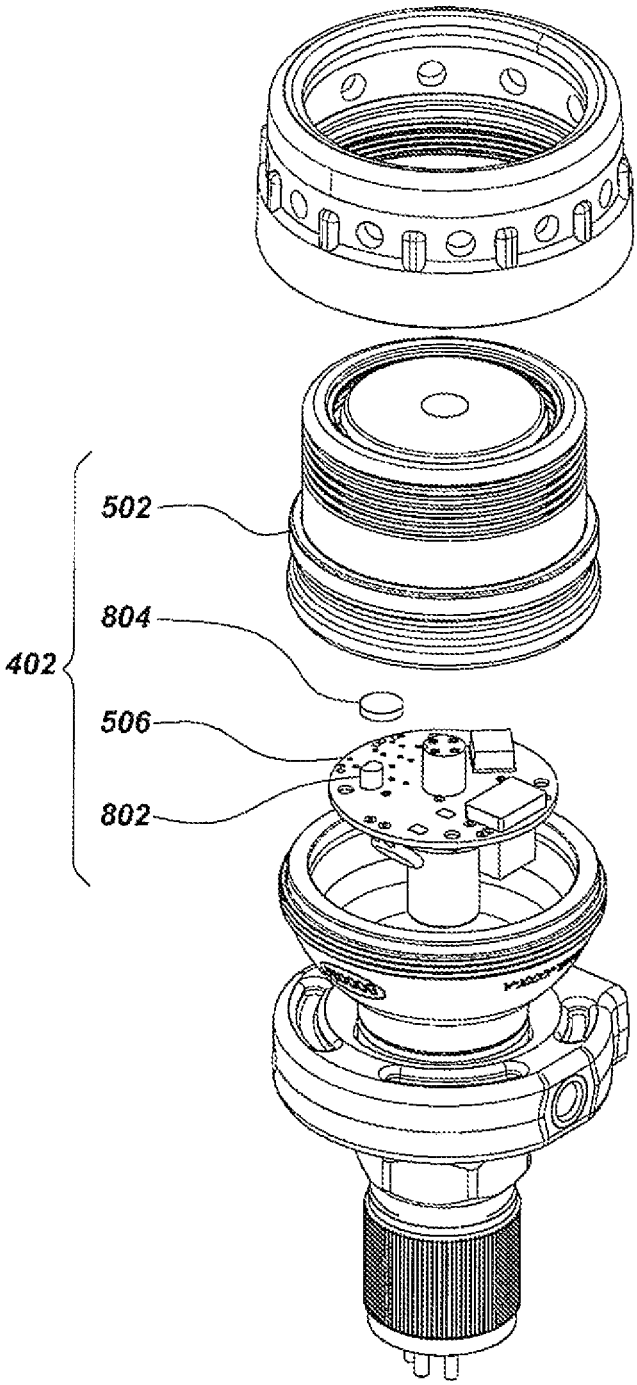
FIG. 8 is an exploded view of the light of FIG. 4 illustrating its thermal sensor.

FIG. 8 is an exploded view of the deep submersible light 402 showing the thermal sensor 802 on the electronic LED driver 506 and thermal conductive pad 804 that thermally connects the thermal sensing component of the LED electronic driver 506 to the light head sub-assembly 502.

Figure 9:
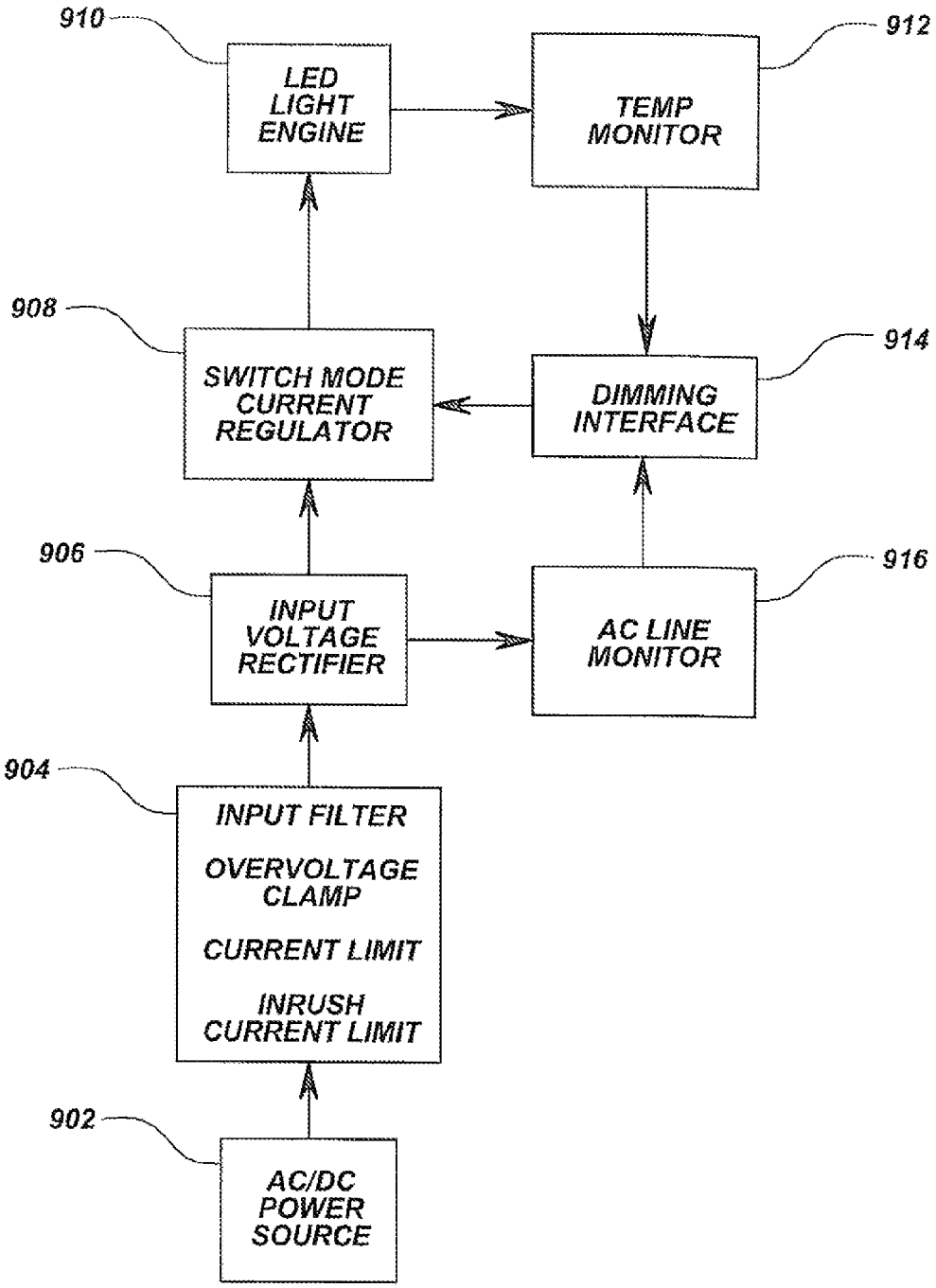
FIG. 9 is a block diagram of the LED driver circuit of the light of FIG. 4.

FIG. 9 is a block diagram of the LED driver circuit illustrating the power flow from an AC/DC power source 902, through input filter elements 904 (over voltage clamp, current limit, and inrush current limit), to an input voltage rectifier 906, switch mode current regulator 908, to an LED Light engine 910. The LED driver circuit further includes circuit feedback and self-regulating control elements in the form of a temperature monitor 912 to test for overheating, a dimming interface 914 to reduce heat by lowering power, and an AC line monitor 916 to test for under voltage conditions.

Figure 10A:
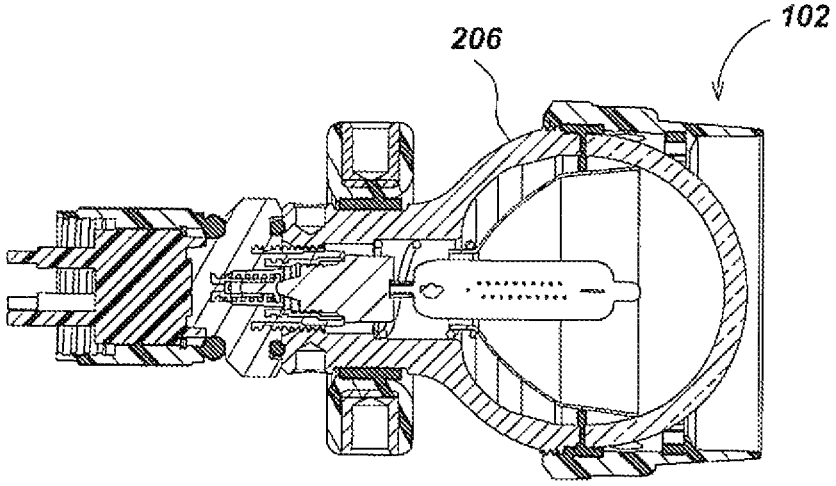
PRIOR ART FIG. 10A
FIGS. 10A and 10B illustrate the manner in which the prior art light fixture of FIG. 1 can be retrofitted with the LED light head that forms a portion of the light of FIG. 4.
Figure 10B:
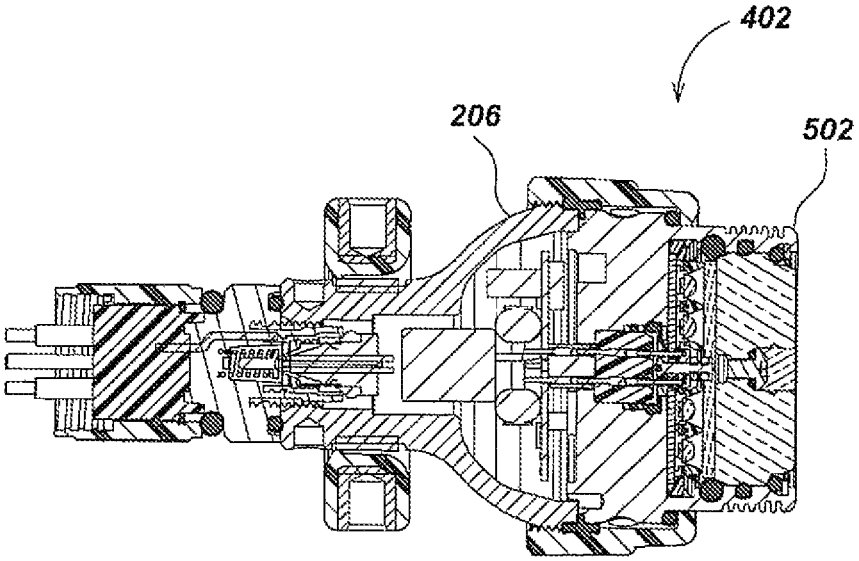

An important aspect of the embodiment of FIG. 4 is that its LED light head sub-assembly 502 can be retrofitted into the body 206 of existing prior art Multi SeaLite™ lights 102 manufactured for many years by DeepSea Power & Light, Inc., the assignee of the subject application, in place of the halogen light head sub-assembly, creating the LED Multi SeaLite™ 402. This retrofit capability is illustrated by the side-by-side views of FIGS. 10A and 10B.

Figure 11:
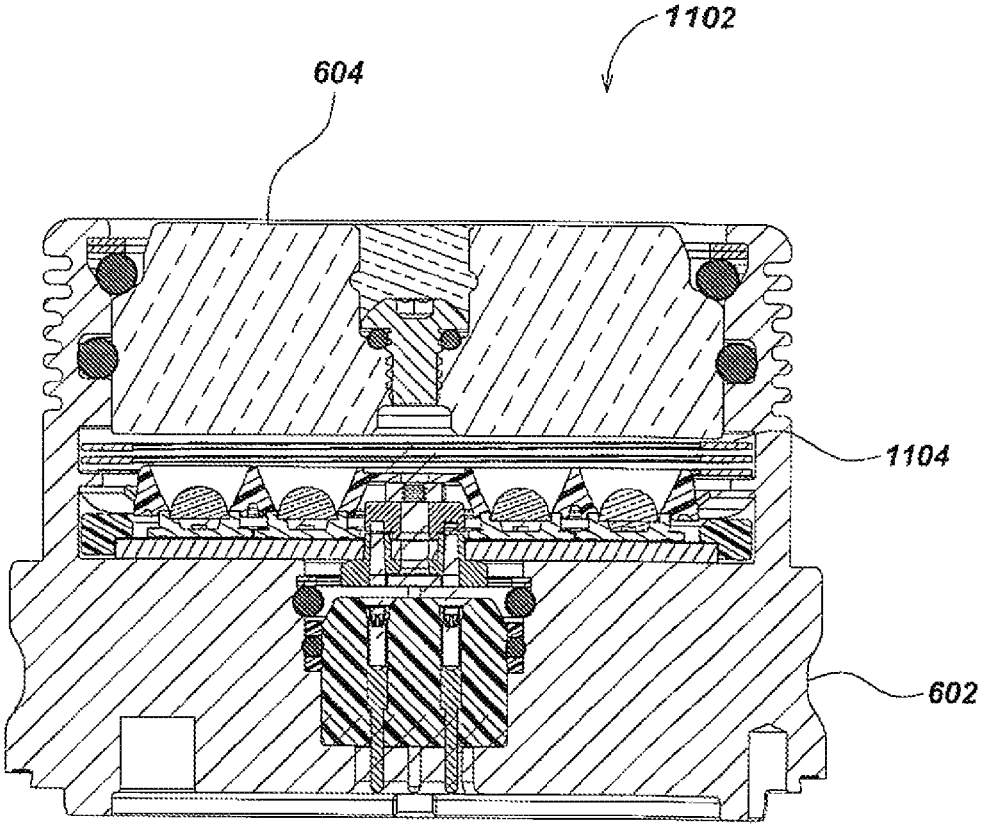
FIG. 11 is a section view illustrating an alternate embodiment of the present invention in which the interior window centering O-ring is replaced by a spring engaging the perimeter of the window.

FIG. 11 illustrates an alternate embodiment 1102 of light head sub-assembly 502 (FIG. 5) in which the interior window centering O-ring 616 (FIG. 6) is replaced by a single coil or wave spring 1104 that engages the rear face of the window 604 and rests on an internal land or flange of the metal body 602.

Figure 12:
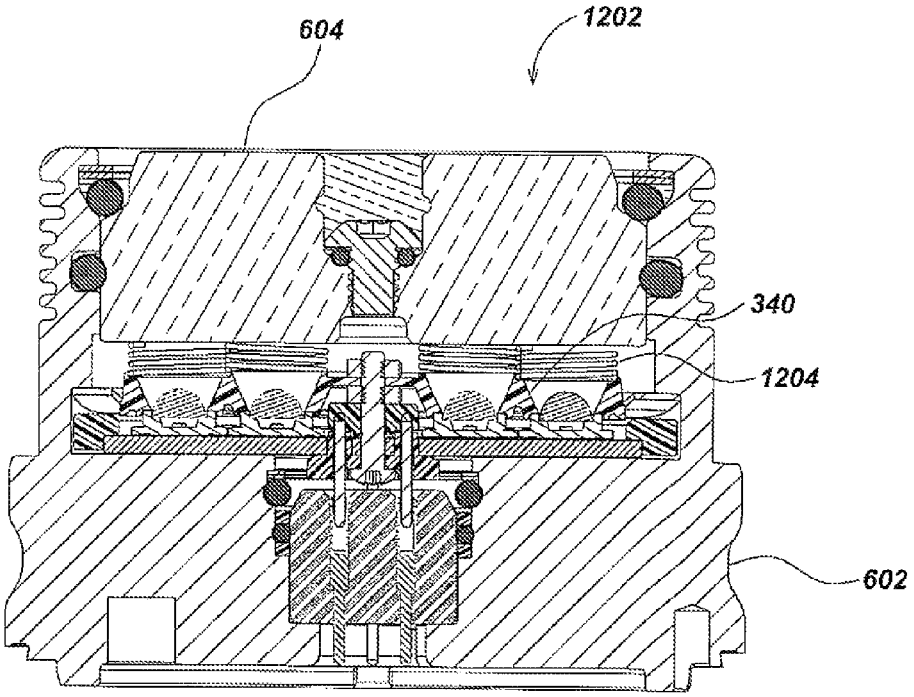
FIG. 12 is a section view illustrating an alternate embodiment of the present invention in which the interior window centering O-ring is replaced by six short springs located on the reflector.

FIG. 12 illustrates an alternate embodiment 1202 of light head sub-assembly 502 (FIG. 5) in which the interior window centering O-ring 616 (FIG. 6) is replaced by six compression springs 1204 that press on the multiple-reflector plate 340, and push against the rear side of the window 604. The springs 1204 provide uniform force to keep the window 604 aligned axially within the bore or hollow interior of the metal body 602.

Figure 13:
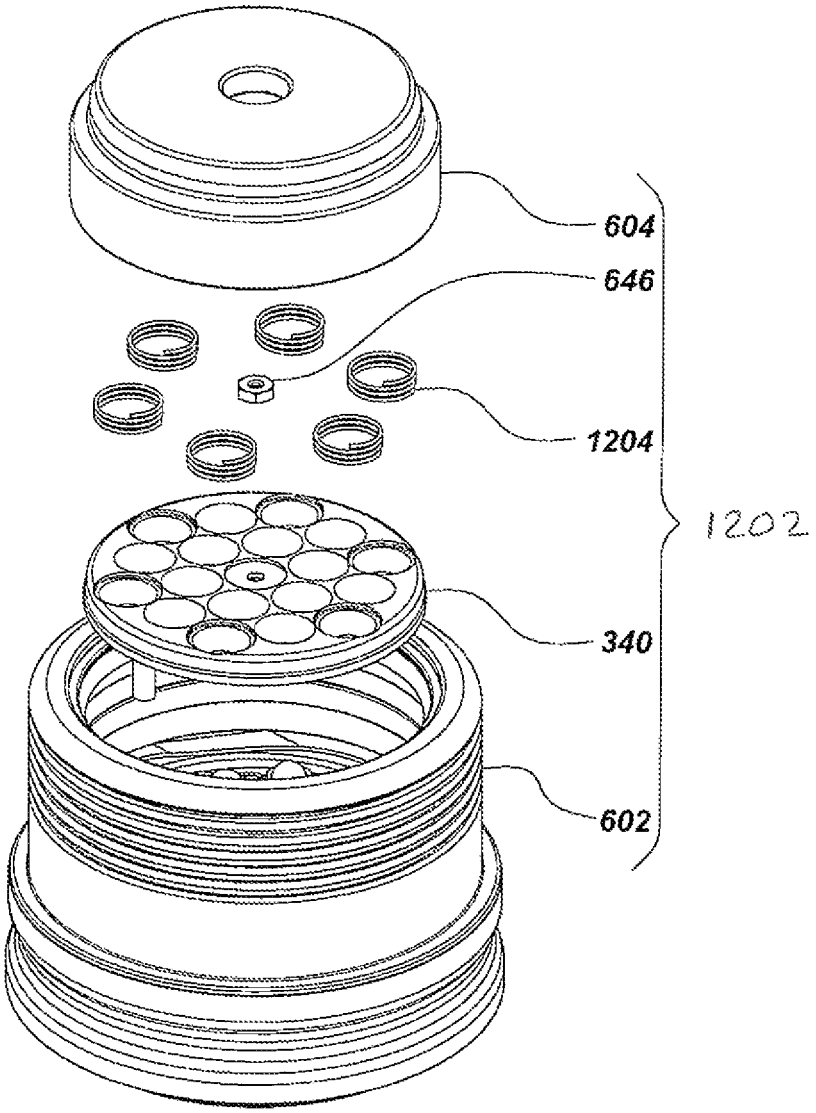
FIG. 13 is an exploded view illustrating construction details of the embodiment of FIG. 12.

The exploded view of 1202 in FIG. 13 further illustrates the relationship of the window 604, the six compression springs 1204, the multiple-reflector plate 340, a hex nut 646, and the metal body 602. In the event of maximum inward movement of the window 604, the hex nut 646 fits within a recess in the backside of the window 604, precluding mechanical interference.

Figure 1:
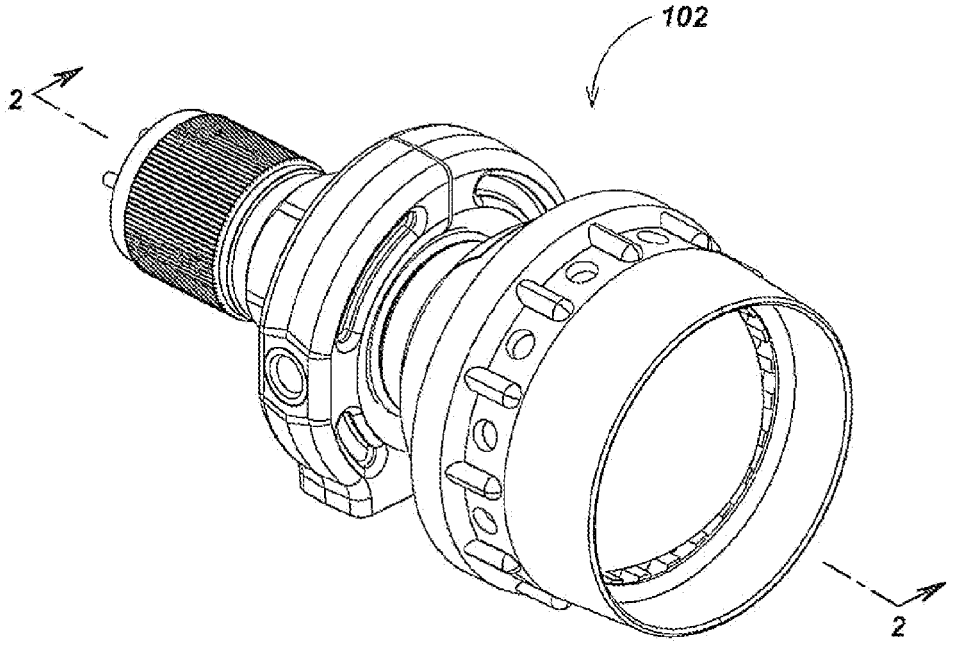
PRIOR ART FIG. 1
FIG. 1 is an isometric view of a prior art deep submersible light fixture that incorporates a halogen gas-filled glass envelope lamp that must be protected from direct exposure to high ocean pressure.
Figure 2:
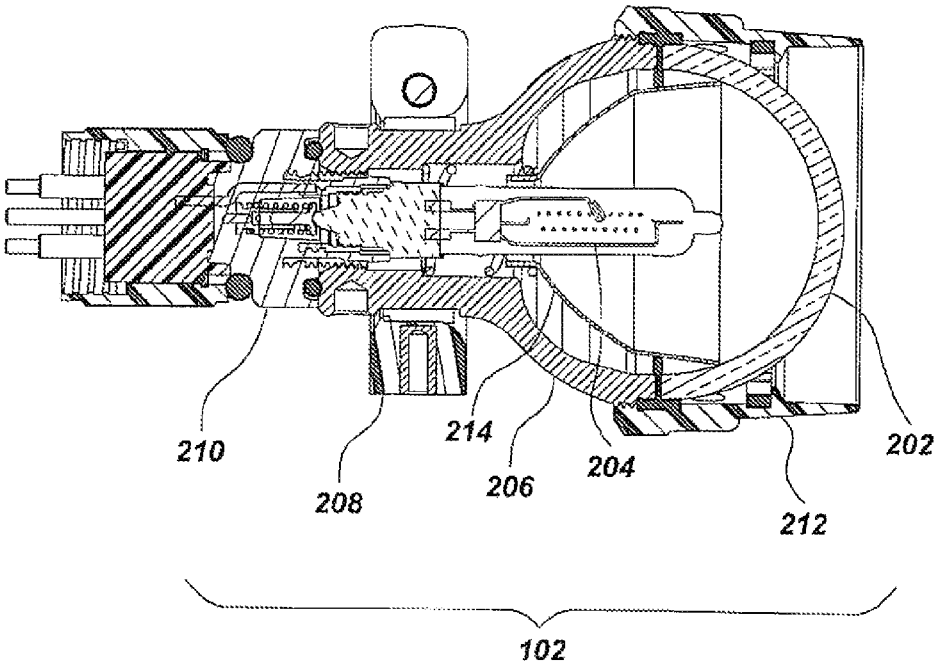
PRIOR ART FIG. 2
FIG. 2 is a sectional side view of the light fixture of FIG. 1 taken along line 2.
Figure 14:
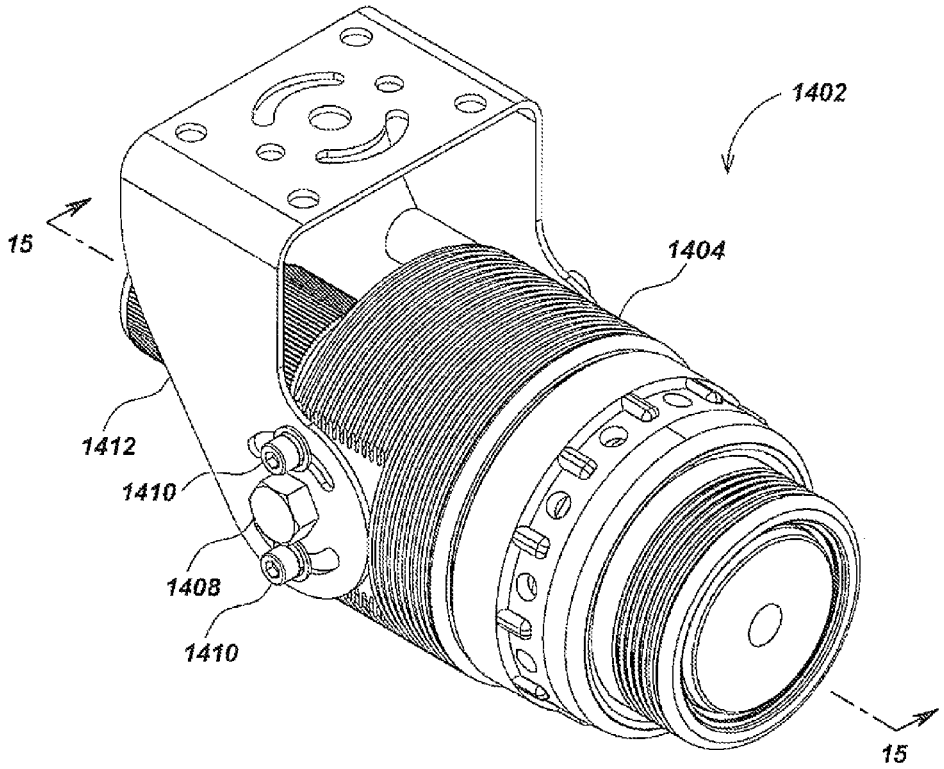
FIG. 14 is an isometric view illustrating the light head and retaining collar of the FIG. 4 embodiment fitted to an alternate embodiment of the back housing and light mount.
Figure 15:
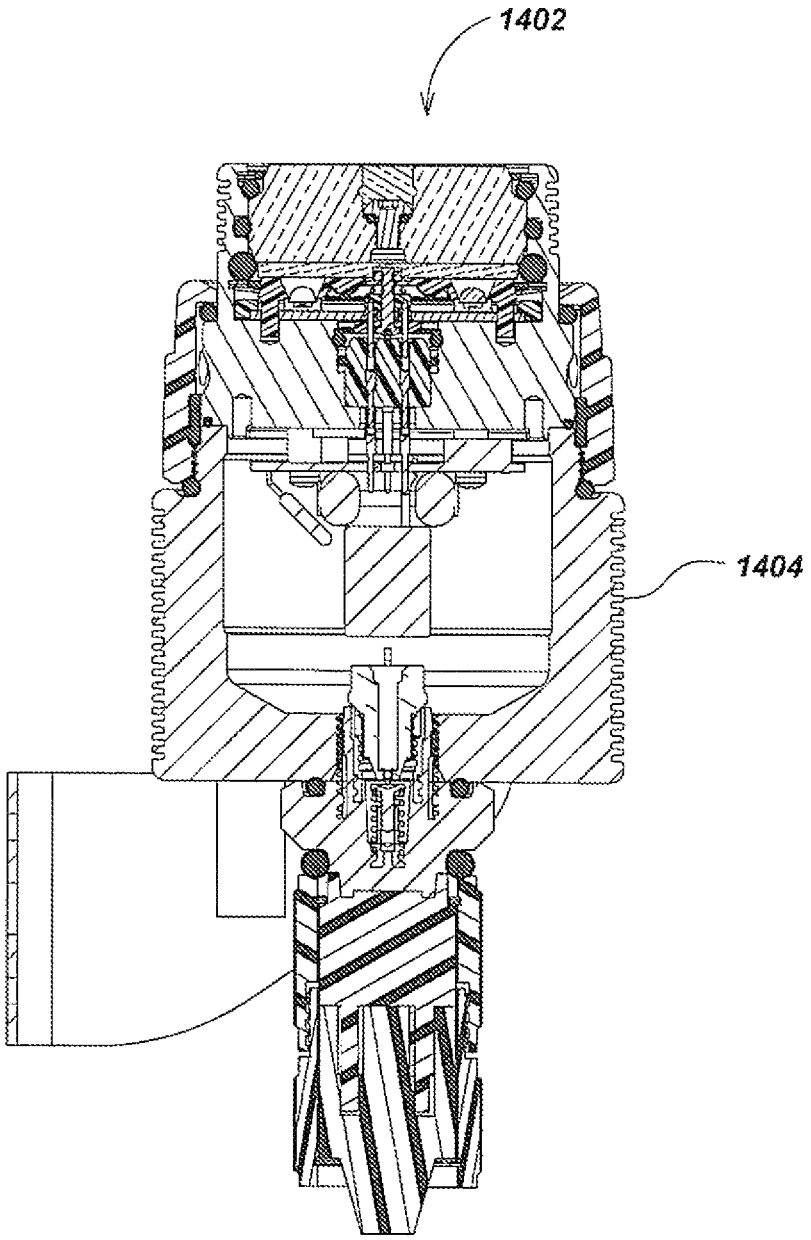
FIG. 15 is a section view taken along line 15-15 of FIG. 14.
Figure 16:
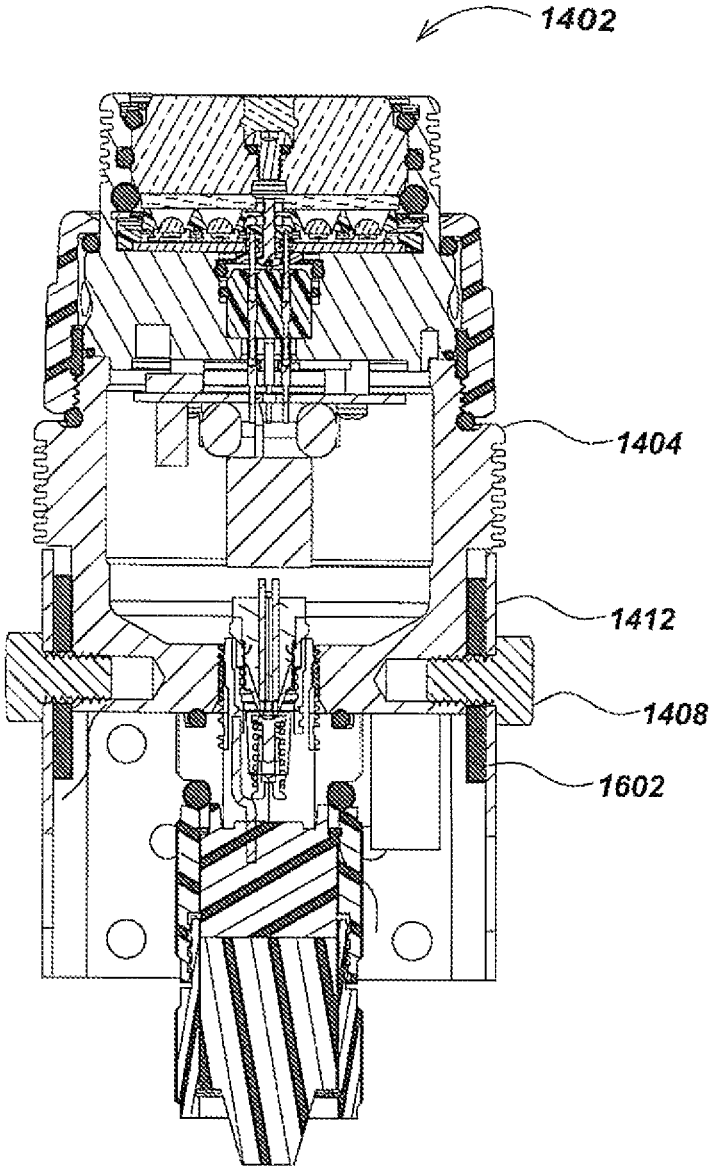
FIG. 16 is a section view rotated ninety degrees relative to FIG. 15.

Referring to FIG. 14 in an alternate embodiment 1402 a back housing 1404 replaces the back shell 206 (FIG. 2). The light is centered in a U-shaped light mount 1412 using a shoulder bolt 1408, and secured with two cap screws 1410. FIG. 15 is a section view taken along line 15-15 of FIG. 14, and illustrates the increased volume of 1402 with the larger back housing 1404, permitting more LED drive circuitry to be placed inside the same. FIG. 16 is a section view of the alternate embodiment 1402 rotated ninety degrees about the axial centerline relative to FIG. 15. FIG. 16 illustrates a fiber or rubber washer 1602 that functions as a friction element of the mounting mechanism, allowing the light mount 1412 to positively clamp to the back housing 1404, with all three structures held in alignment by the shoulder bolt 1408.

Figure 17:
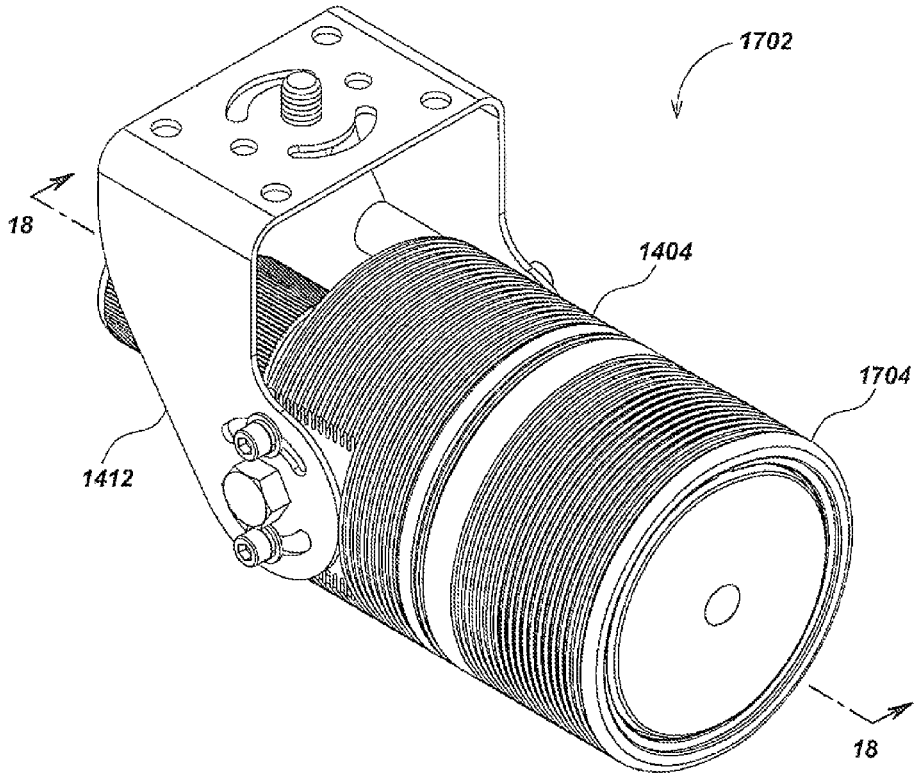
FIG. 17 illustrates an alternate embodiment of the light head of the FIG. 4 embodiment, mounted to the back housing illustrated in FIG. 14.
Figure 18:
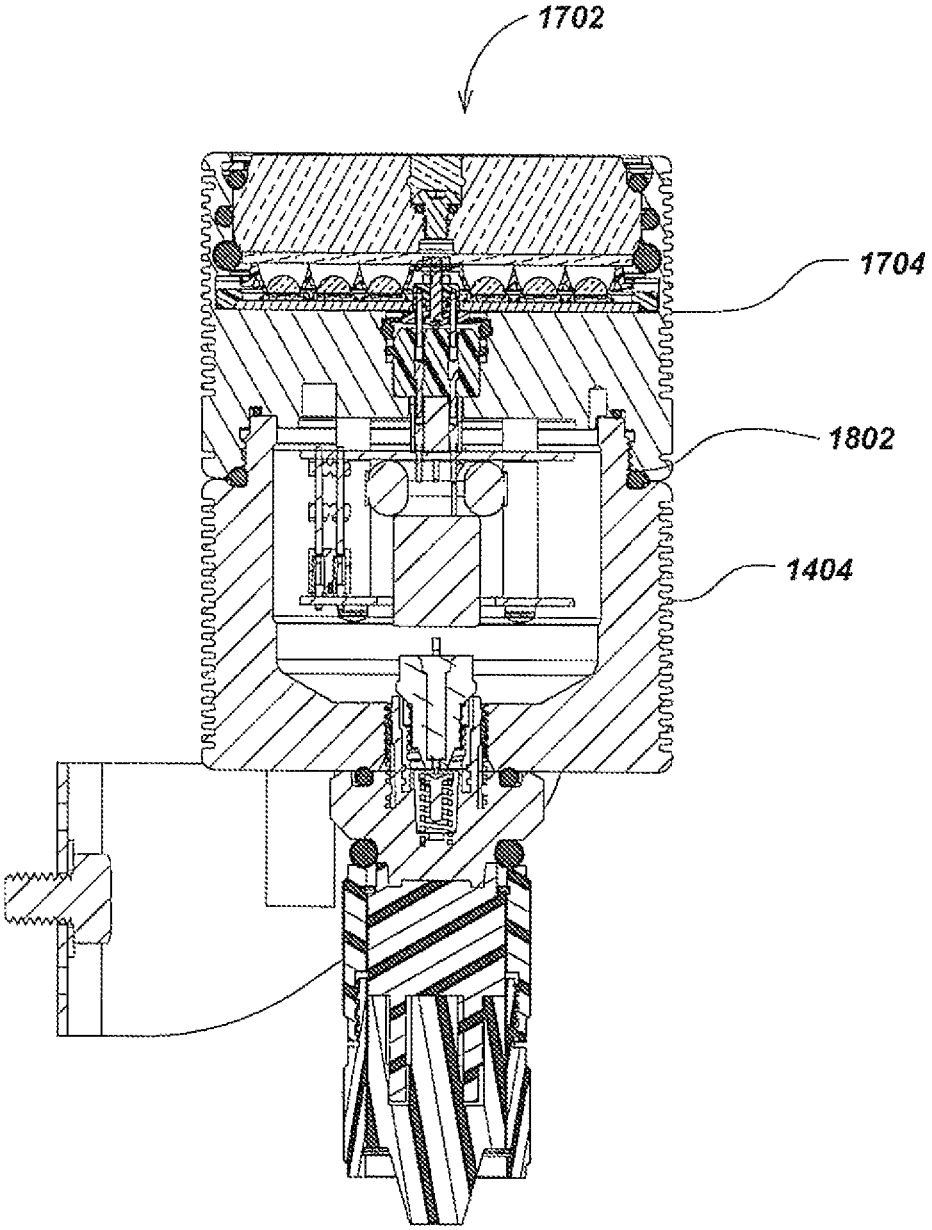
FIG. 18 is a section view taken along line 18-18 of FIG. 17.
Figure 19:
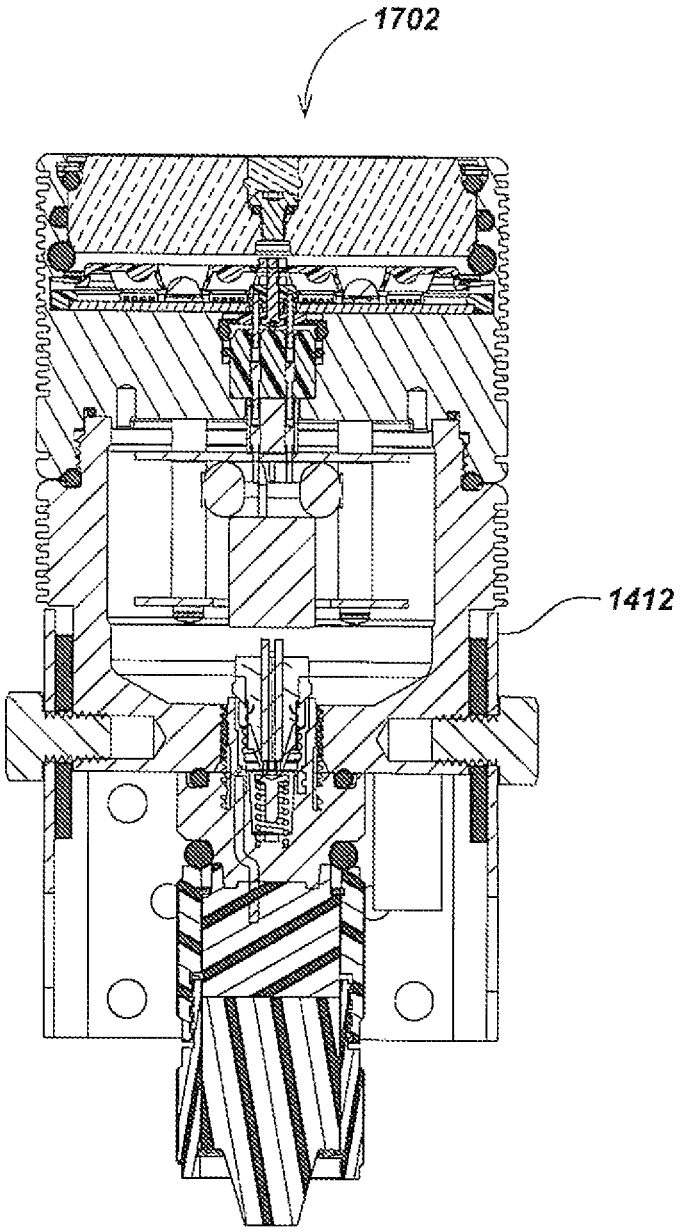
FIG. 19 is a section view rotated ninety degrees relative to FIG. 18.

FIG. 17 illustrates an alternate embodiment 1702 in which the light head 1704 is mounted to the back housing 1404. The embodiment 1702 uses the same light mount 1412 as the embodiment 1402 (FIG. 14). FIG. 18 is a section view of the embodiment 1702 of FIG. 17 along the line 18-18, illustrating the alternate embodiment 1702, composed of the light head 1704 mounted to the back housing 1404. An O-ring 1802 is used to keep sea water and debris out of the mating threads to prevent corrosion, fouling, and galling. FIG. 19 is a section view of the alternate embodiment 1702 rotated ninety degrees about the axial centerline relative to FIG. 18, showing details of the same light mount 1412 as the embodiment 1402 (FIG. 14).

Figure 20A:
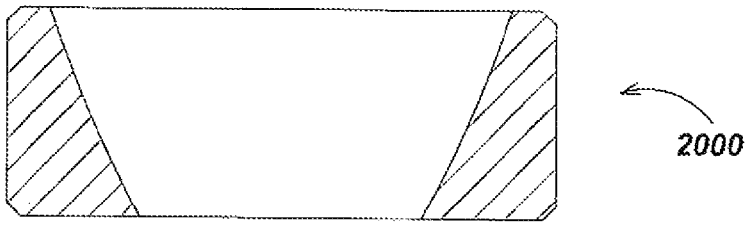
FIGS. 20A, 20B, 20C and 20D illustrate four alternate miniature reflector shapes for redirecting the edge light of the LEDs.
Figure 21A:
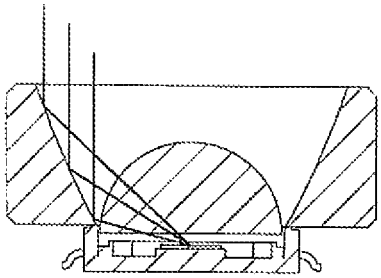
FIGS. 21A, 21B, 21C and 21D illustrate in diagrammatic fashion the resultant light patterns from the four alternate miniature reflector shapes embodied in FIGS. 20A, 20B, 20C and 20D, respectively.

FIG. 20A illustrates an alternate miniature smooth parabolic spot pattern reflector 2000 for use with the multiple-reflector plate 340 (FIG. 3). The resultant light pattern with substantially parallel rays is illustrated in FIG. 21A.

Figure 20B:
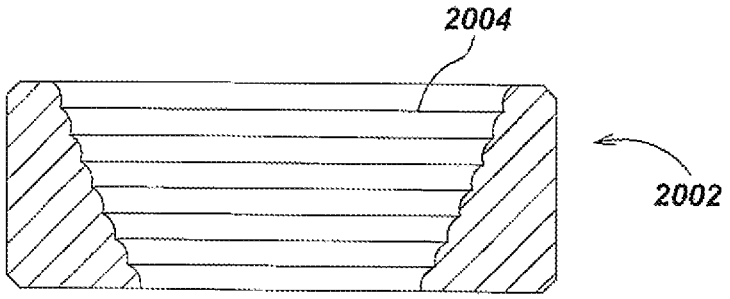
Figure 21B:
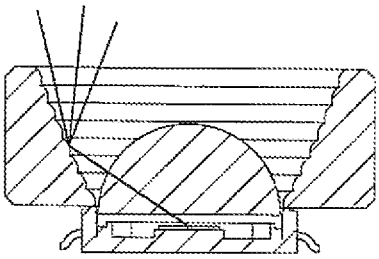

FIG. 20B illustrates an alternate miniature parabolic flood pattern reflector 2002 with circumferentially extending convex or concave stepped rings 2004 for use with the multiple-reflector plate 340 (FIG. 3). The resultant light pattern with spread rays is illustrated in FIG. 21B.

Figure 20C:
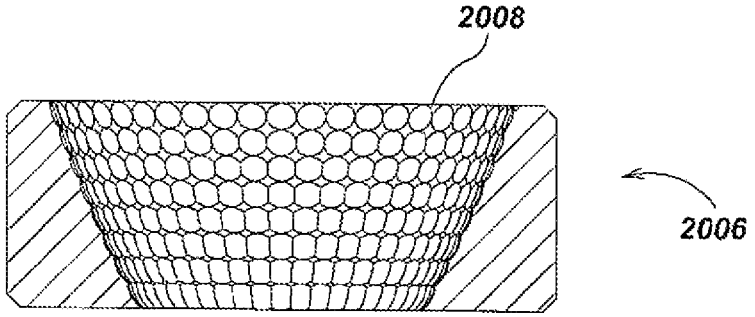
Figure 21C:
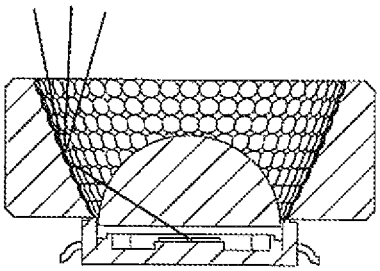

FIG. 20C illustrates an alternate miniature parabolic flood pattern reflector 2006 with micropeened surface made up of a plurality of miniature convex or concave surfaces 2008 for use with the multiple-reflector plate 340 (FIG. 3). The resultant light pattern with spread rays is illustrated in FIG. 21C.

Figure 20D:
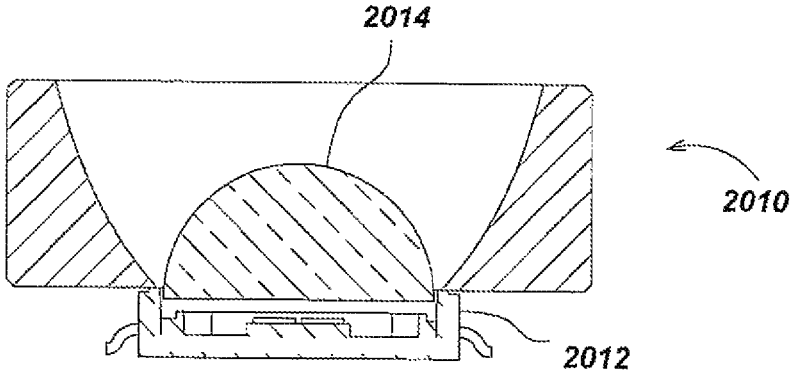
Figure 21D:
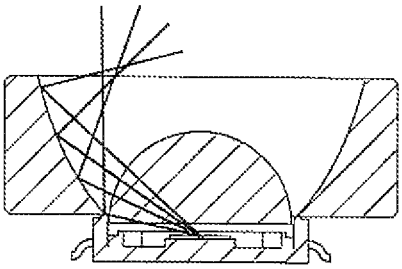

FIG. 20D illustrates an alternate miniature isoradiant flood pattern reflector 2010 for use with the multiple-reflector plate 340 (FIG. 3). A Cree four-die MCE LED 2012 is mounted so that its transparent dome-shaped lens element 2014 extends within the reflector cavity, and the four dies are at an optimal position with respect to the focal point of the reflector, either congruent with or offset from said focal point. The resultant even flood light pattern is illustrated in FIG. 21D.

By way of example, the Cree four die MCE LED 2012 are illustrated in FIGS. 21A, 21B, 21C, and 21D mounted in its operative position relative to the reflectors 2000, 2002, 2006, and 2010 respectively, with resultant light patterns.

Figure 22:
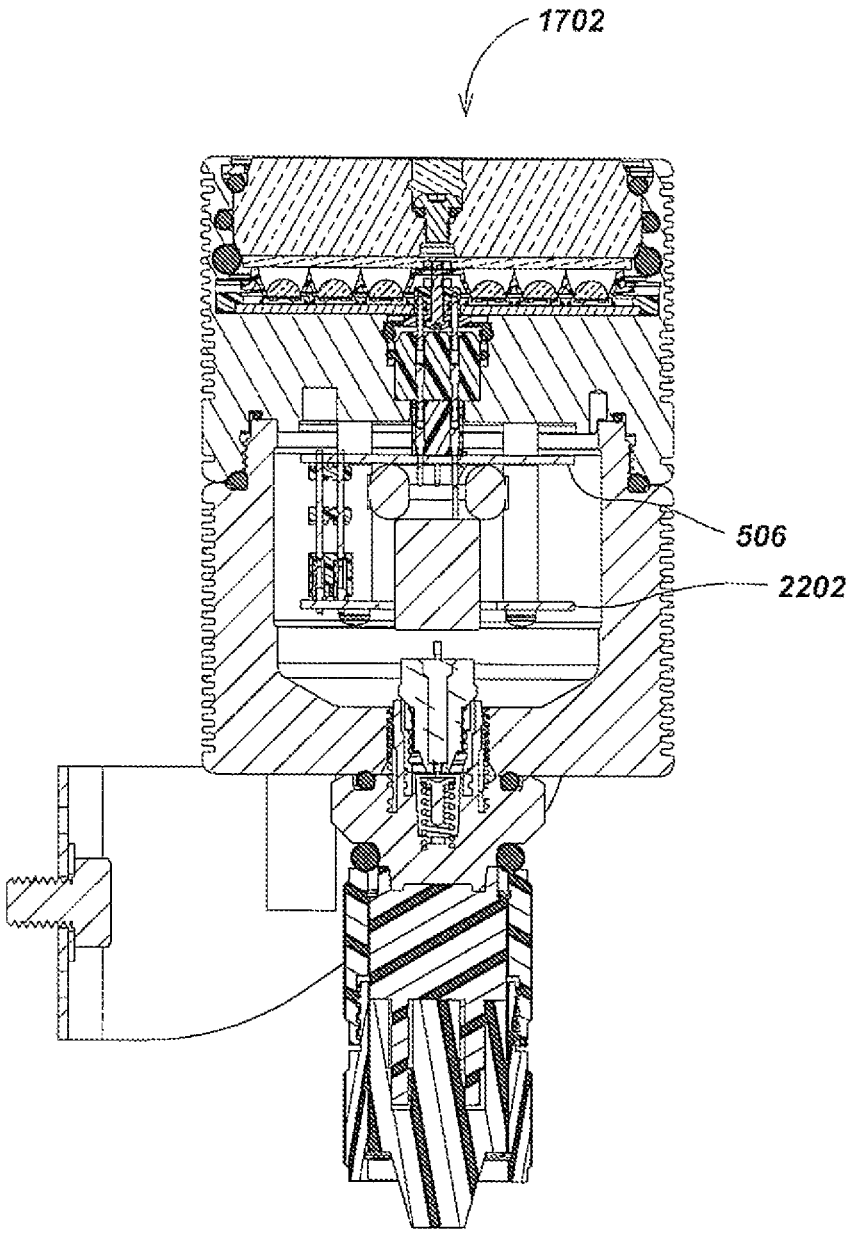
FIG. 22 is a section view of an alternate embodiment of a deep submersible light in accordance with the present invention illustrating the use of a piggyback circuit board to dim the light output of the LED driver board by external control.

FIG. 22 illustrates the use of a piggyback circuit board 2202 with the alternate embodiment 1702 to dim the light output of the electronic LED driver 506 by external control. The modular piggyback circuit board 2202 may be selected based on the type of dimming interfaces encountered, including isolated and non-isolated control voltage (0-10 VDC), current loop (4-20 mA), pulse width modulated (PWM), and serial communications.

Figure 23:
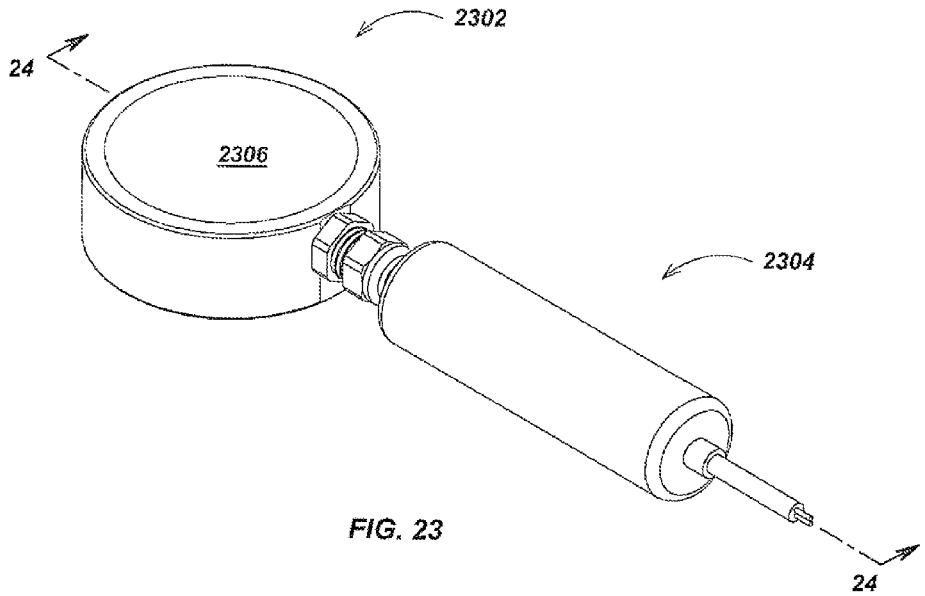
FIG. 23 is an isometric view of an alternate embodiment of a deep submersible light in accordance with the present invention incorporating a cast soft elastomeric window and an in-line driver circuit.

FIG. 23 illustrates an alternate embodiment 2302 of LED light head sub-assembly 502 (FIG. 5) that incorporates a cast soft elastomeric transparent window 2306 for pressure compensation. The light illustrated in FIG. 23 also incorporates an in-line LED driver assembly 2304, wherein a circuit board is encapsulated within a cylindrical elastomeric housing providing similar pressure compensation.

Figure 24:
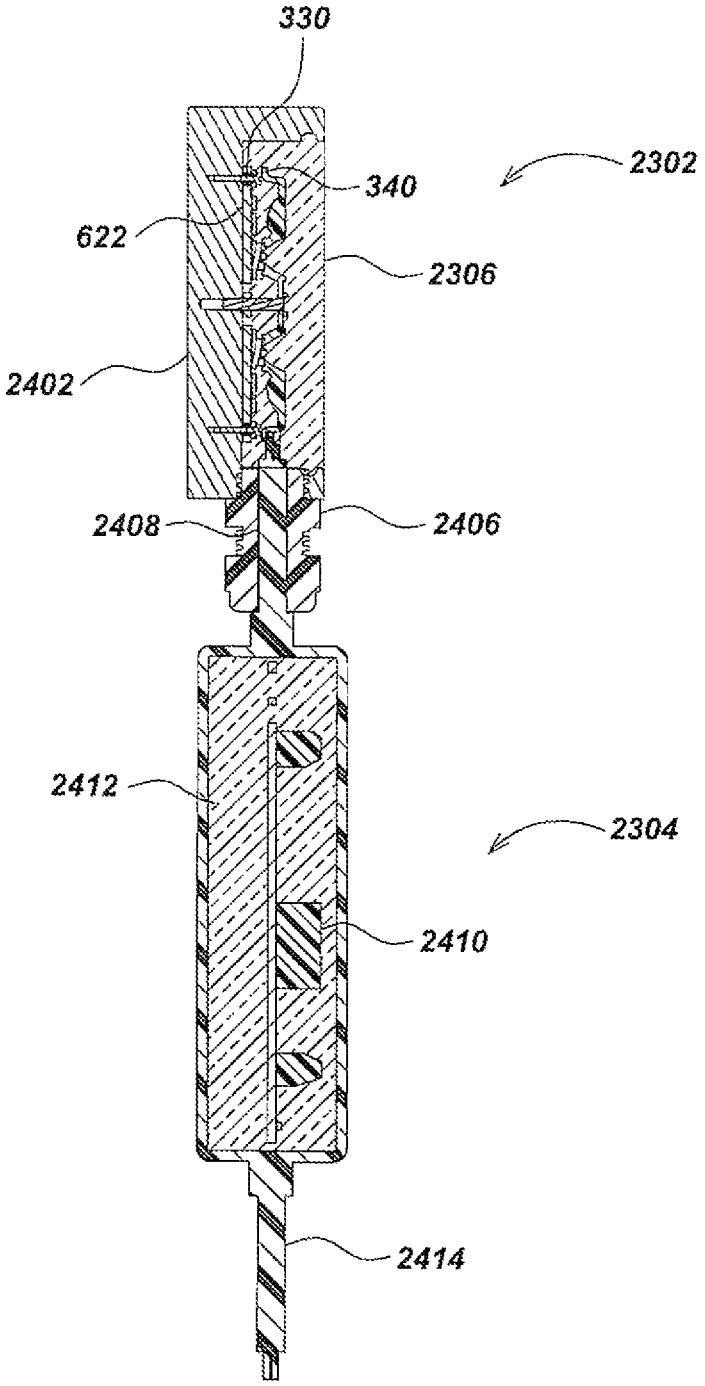
FIG. 24 is a section view of the light of FIG. 23 taken along line 24-24.

FIG. 24 is a section view of FIG. 23 along the lines 24-24, showing the alternate embodiment of the light head 2302, composed of a metal housing 2402 that encloses the LED/MCPCB sub-assembly 330 that is thermally connected to the metal housing 2402 using a phase change material (PCM) 622. Machine screws 2506 (illustrated in FIG. 25) hold the LED/MCPCB sub-assembly 330 to the metal housing 2402. A center screw 2508 (shown in FIG. 25) holds the multi-cavity reflector plate 340 over the LED/MCPCB sub-assembly 330. An optically transparent, high dielectric, non-hygroscopic, soft durometer, castable elastomer 2306 fills all voids. The two-part castable elastomer 2306 preferably has a low viscosity and a one-hour minimum pot life during its working phase in order to fill every small crevice and void. After it cures, the compliance of this material to external pressure provides the means of compensation to the LEDs. One suitable commercially available material for the elastomer 2306 is NuSil LS-6143. The LED driver assembly 2304 is shown remote from the LED light head sub-assembly 2302, separated by an appropriate length of underwater electrical cable 2408, here shown at minimum length. The cable entry to the LED light head 2302 is sealed with a low cost compression fitting 2406, such as a Heyco Liquid Tight Cordgrips (p/n M3210). The LED driver assembly 2304 is comprised of an LED driver electronics 2410 encapsulated by a thermally conductive, non-hygroscopic, soft durometer castable elastomer 2412, which has no requirement for optical clarity. One suitable commercially available material for the elastomer 2412 is Dow Corning Thermally Conductive Elastomer SYLGARD Q3-6632. An additional length of underwater electrical cable 2414 connects the LED driver electronics 2410 to electrical power. The cables 2408 and 2414 are cast in place and sealed watertight within the body of 2304 by the castable elastomer 2412, requiring no additional seal fitting such as 2406. The principal advantage of the embodiment of FIGS. 23 and 24 is that the light head is placed where light is needed, but minimum profile is required, such as the inside wrist of a vehicle manipulator (robotic arm) on a deep submersible vehicle.

Figure 25:
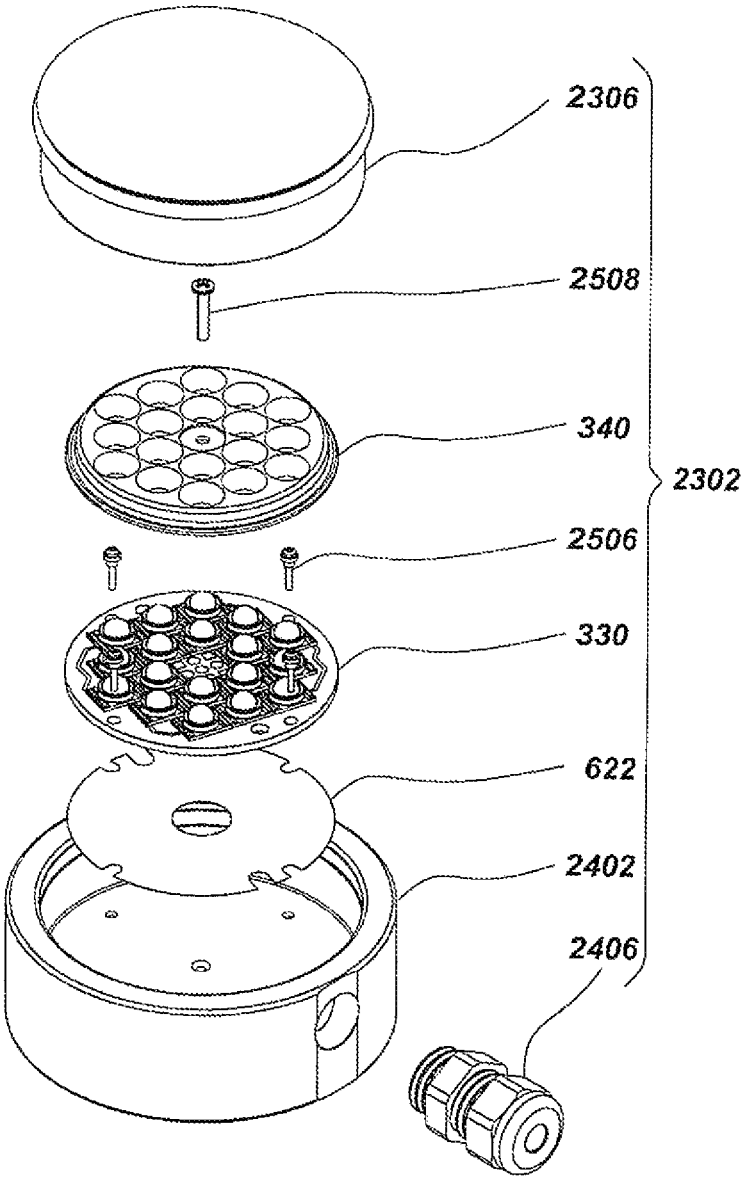
FIG. 25 is an enlarged exploded section view of the light head assembly of the light of FIG. 23.

FIG. 25 further illustrates the mounting relationship of the components of the LED light head assembly 2302 and the metal housing 2402, LED/MCPCB sub-assembly 330, phase change material (PCM) 622, held by three machine screws 2506, multiple-reflector plate 340, held by machine screw 2508, and the optically clear, high dielectric, non-hygroscopic, soft durometer, castable elastomer window 2306. A rib extends around the perimeter to help seal and retain the window 2306. The compression fitting 2406 is shown as part of the LED light head assembly 2302.

Figure 26A:
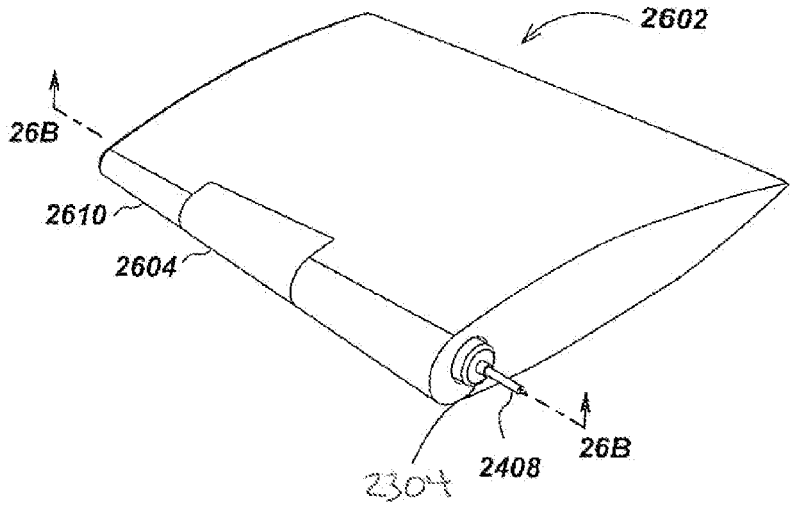
FIG. 26A is an alternate embodiment similar to the light of FIG. 23 in which the shape of the cast soft elastomeric window blends to match the adjacent hydrodynamic shape of an underwater control surface of a deep submersible vehicle.

FIG. 26A illustrates an alternate embodiment 2602 of castable elastomer window 2306 (FIG. 23). The shape of the cast soft elastomeric window 2604 is blended to match or conform to the adjacent hydrodynamic shape of a control surface 2610 of an underwater vehicle. The control surface 2610 could either be a fixed dive plane, active dive plane, or a rudder. The LED driver assembly 2304 and underwater electrical cable 2408 are shown recessed within the leading edge of the dive plane.

Figure 26B:
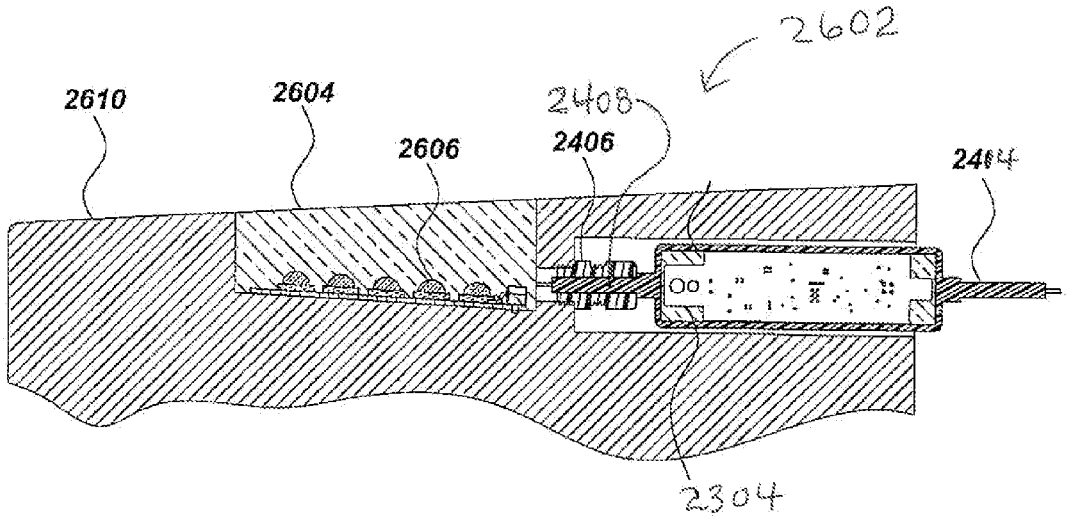
FIG. 26B is a section view of FIG. 26A taken along line 26B-26B.

FIG. 26B is a section view of 2602 in FIG. 26A taken along line 26B-26B, showing the LED driver assembly 2304 remote from the LED light engine 2606, separated by an appropriate length of underwater electrical cable 2408, here shown at minimum length, and sealed through a low cost compression fitting 2406. This allows placement of the driver electronics 2410 at any distance convenient to the submarine builder. The elastomeric window 2604 is shown as a functional mechanical part of the control surface 2610. An appropriate length of underwater electrical cable 2414 connects the LED driver assembly 2304 to electrical power.

Figure 27:
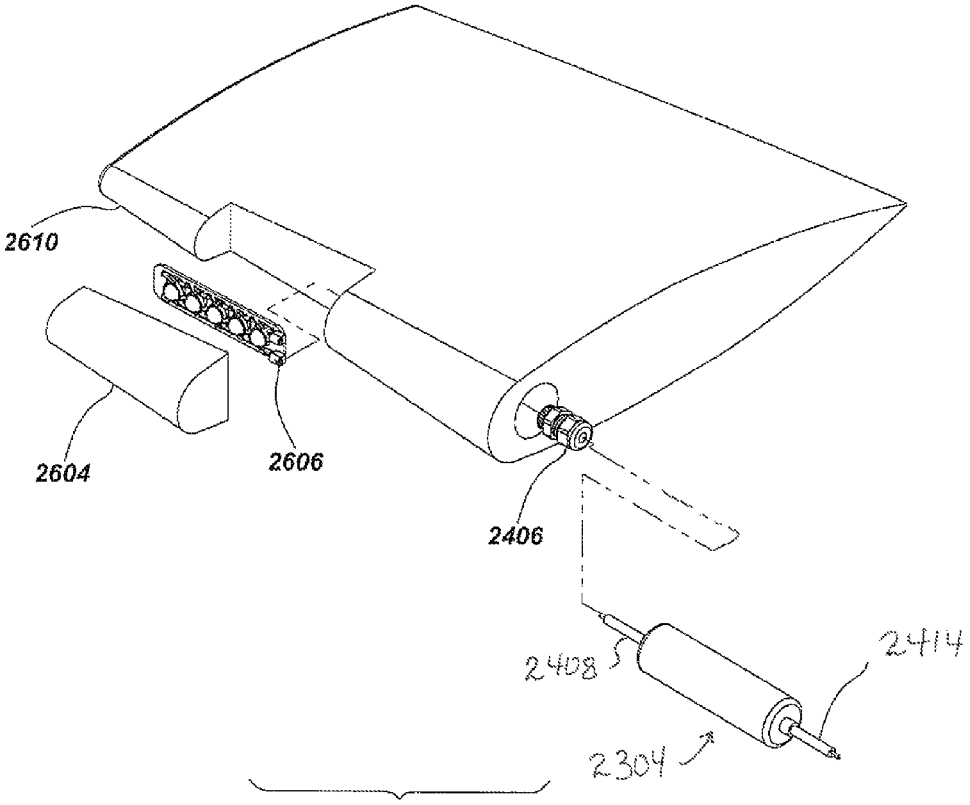
FIG. 27 is a partially exploded view of FIG. 26.

FIG. 27 illustrates a partially exploded view of the castable window 2604 and LED light engine 2606 removed from its recessed pocket in the control surface 2610. Though shown separated, the castable window 2604 fully encapsulates the LED light engine 2606. LED driver assembly 2304 with underwater electrical cables 2408 and 2414, is shown removed from the recess inside the leading edge of the control surface 2610, and separated from the compression fitting 2406.

Figure 28A:
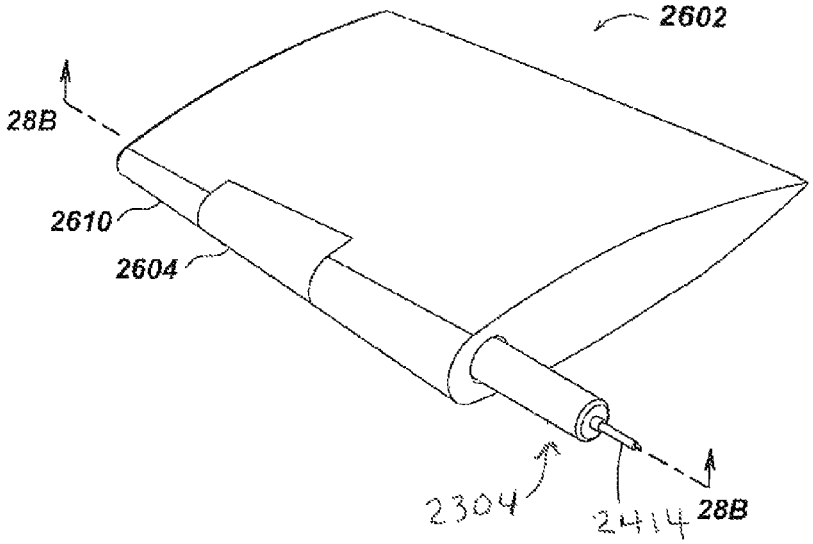
FIG. 28A is an alternate embodiment similar to the light of FIG. 26A.

FIG. 28A is an alternate embodiment similar to 2602 of FIG. 26A, showing the cast soft elastomeric window 2604 blended to match or conform to the adjacent hydrodynamic shape of a control surface 2610 of an underwater vehicle. The LED driver assembly 2304 and underwater electrical cable 2414 are shown extending from the recess pocket within the leading edge of the control surface 2610. An appropriate length of underwater electrical cable 2414 connects the LED driver assembly 2304 to electrical power.

Figure 28B:
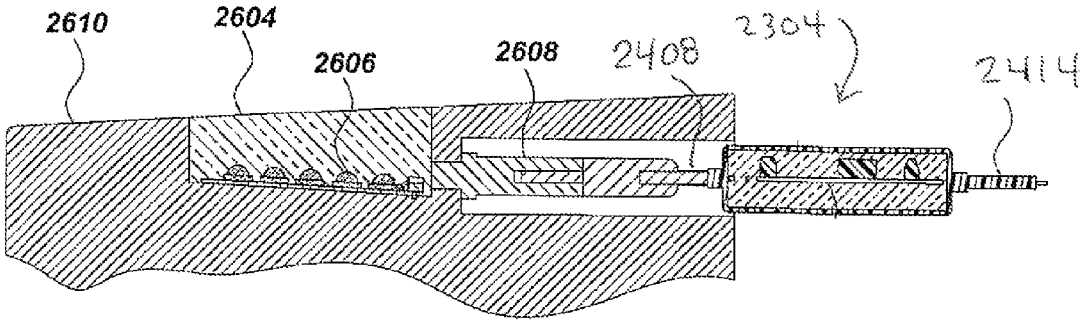
FIG. 28B is a section view of FIG. 28A taken along line 28B-28B.

FIG. 28B is a section view of FIG. 28A taken along line 28B-28B, showing the LED driver assembly 2304 remote from the LED light engine 2606, separated by an appropriate length of underwater electrical cable 2408, here shown at minimum length, bonded to an underwater in-line connector pair 2608 rated for depth and power. An in-line underwater electrical connector 2608 allows simple assembly of the LED driver assembly 2304 and LED light engine 2606, and allows placement of the LED driver assembly 2304 at any distance convenient to the submarine builder. The elastomeric window 2604 is shown as a functional mechanical part of the control surface 2610. An appropriate length of underwater electrical cable 2414 connects the LED driver assembly 2304 to electrical power.

Figure 29A:
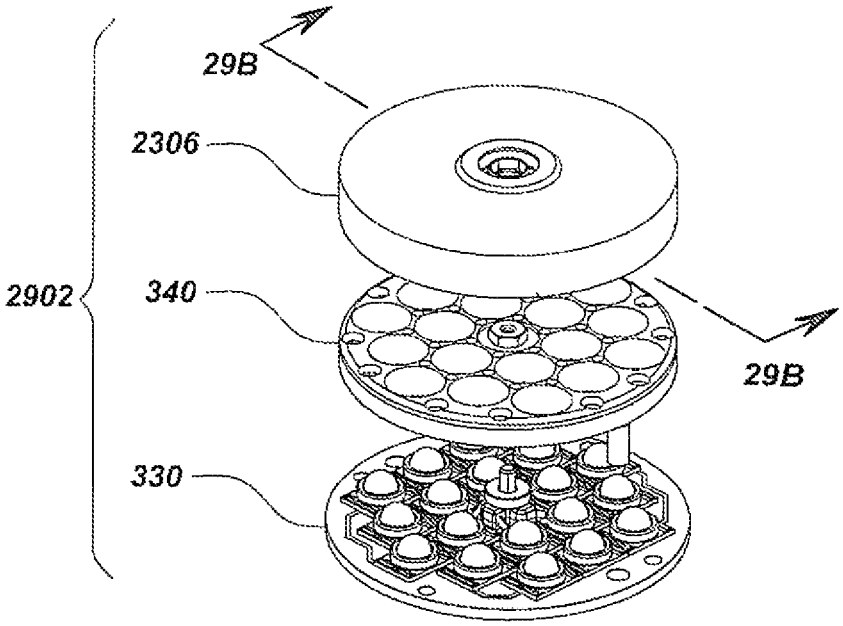
FIGS. 29A and 29B illustrate an alternate embodiment of the LED/reflector sub-assembly for the light of FIG. 4.

FIG. 29A illustrates the assembly of an LED light engine subassembly 2902 using LED/MCPCB sub-assembly 330, electrical pins 652 (FIG. 6), insulating centering plate 654 (FIG. 6), insulating top cap 650 (FIG. 6), through-bolt 648 (FIG. 6), and a hex nut 646 (FIG. 6). The multiple-reflector plate 340 is then added to this stack-up and held by a hex nut 624 (FIG. 6). This entire sub-assembly is then encapsulated in an optically clear, high dielectric, non-hygroscopic, soft durometer castable elastomer 2306, which fills all voids between the front of LED light engine 330, and the entirety of the multiple-reflector plate 340. The back of the LED light engine 330 is left bare, as is its edge, and a small land area on the front for final assembly in the same manner illustrated in FIG. 6A. The elastomer 2306 provides pressure compensation, reduces the volume of compensating dielectric fluid, grease, or gel 510 (FIG. 5) required, and eliminates any undesirable chemical affects of the compensating dielectric fluid, grease, or gel 510 (FIG. 5) on the LED dies 306 (FIG. 3).

Figure 29B:
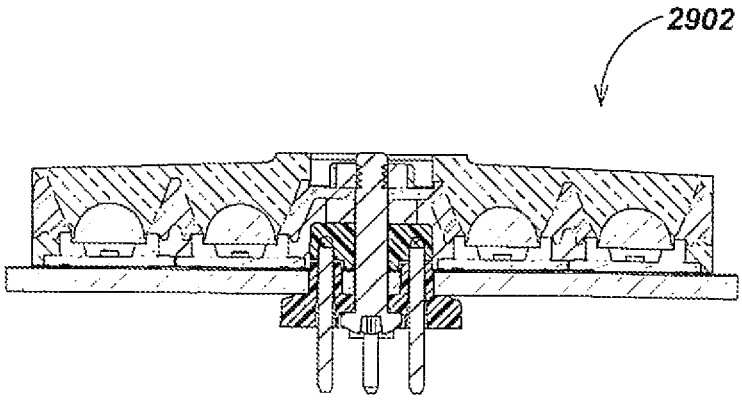

FIG. 29B is a section view of the light engine subassembly 2902 of FIG. 29A taken along line 29B-29B. This subassembly is shown in a full light assembly in FIG. 30.

Figure 30:
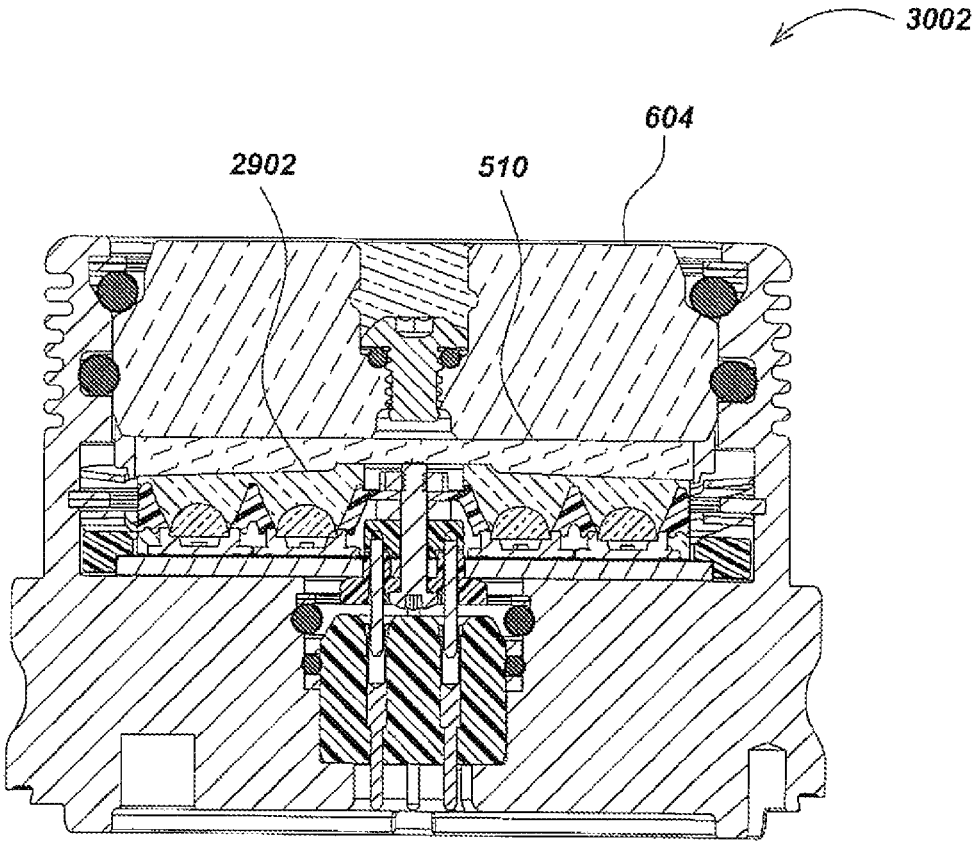
FIG. 30 is a section view of the alternate light head embodiment for the light of FIG. 4.

FIG. 30 illustrates an alternate embodiment of the invention 3002 that incorporates the cast light engine sub-assembly 2902 as part of a hybrid pressure compensation technique. The cast light engine sub-assembly 2902 is constrained in the same manner illustrated in FIG. 6A. A pressure compensating dielectric fluid, grease, or gel 510 fills the remaining void between the cast light engine sub-assembly 2902, and the pistoning clear plastic window 604.

While several embodiments of deep submersible lights and light head assemblies have been described and illustrated in detail, it should be apparent to those skilled in the art that our invention can be modified in arrangement and detail. For example, other solid state sources of illumination could be used besides LEDs. The relatively thick, substantially rigid window 604 could be replaced with a thinner flexible, but otherwise hard window, as taught in the Ser. No. 12/036,178 application incorporated by reference above. Therefore, the protection afforded our invention should only be limited in accordance with the scope of the following claims.

The previous description of the disclosed embodiments and aspects is provided to enable any person skilled in the art to make or use the present disclosure. Various modifications to these embodiments and aspects will be readily apparent to those skilled in the art, and the generic principles defined herein may be applied to other embodiments and aspects without departing from the spirit or scope of the disclosure. Therefore, the presently claimed invention is not intended to be limited specifically to the aspects and embodiments shown herein, but is to be accorded the widest scope consistent with the appended Claims and their equivalents.

We claim:

1. A deep submersible light, comprising:

a body defining an interior volume;

a light engine assembly including a plurality of light emitting diodes (LEDs) and a metal core printed circuit board disposed within the interior volume;

a non-moving soft elastomeric window; and an optically transparent liquid or gel material disposed within the interior volume in direct contact with the LEDs for compensating for volumetric changes of the body due to temperature and/or pressure changes caused by deep water submergence.

2. The deep submersible light of claim 1, comprising an in-line LED driver assembly having a circuit board encapsulated within an elastomeric housing.

3. A deep submersible light, comprising:

a body defining an interior volume;

a light engine assembly including a plurality of light emitting diodes (LEDs) and a metal core printed circuit board disposed within the interior volume;

a non-moving soft elastomeric window; and an optically transparent liquid or gel material disposed within the interior volume in direct contact with the LEDs for compensating for volumetric changes of the body due to temperature and/or pressure changes caused by deep water submergence, wherein the body comprises a metal housing enclosing the light engine assembly, with the light engine assembly thermally coupled to the metal housing using a phase change material.

4. The deep submersible light of claim 1, wherein the elastomeric window comprises a low viscosity cast elastomer material having a pot life of one hour or more.

5. The deep submersible light of claim 1, further comprising a multi-reflector plate.

6. The deep submersible light of claim 1, wherein the elastomeric window comprises a soft durometer non-hygroscopic material.

7. The deep submersible light of claim 1, further comprising a compression fitting positioned within an opening of the body.

8. The deep submersible light of claim 1, wherein the body is structurally configured to withstand ambient external pressure of at least 2000 pounds per square inch (PSI).

9. The deep submersible light of claim 1, wherein the body includes a rib extending around the perimeter to retain and seal the elastomeric window.

10. The deep submersible light of claim 6, further including a phase change material (PCM) positioned between the body and the light engine assembly.

11. The deep submersible light of claim 1, wherein the elastomeric window is shaped to conform to a surface of an underwater vehicle.

12. The deep submersible light of claim 11, wherein the elastomeric window is shaped to conform to a control surface of the underwater vehicle.

13. The deep submersible light of claim 11, wherein the underwater vehicle is a submarine.

* * * * *